US007243519B1

(12) United States Patent
Chuang

(10) Patent No.: US 7,243,519 B1
(45) Date of Patent: Jul. 17, 2007

(54) ROLL-FORMING MACHINE

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 141 days.

(21) Appl. No.: 11/086,328

(22) Filed: Mar. 23, 2005

(51) Int. Cl.
*B21D 5/08* (2006.01)

(52) U.S. Cl. ..... 72/181; 72/226

(58) Field of Classification Search ..... 72/181, 72/180, 176, 226
See application file for complete search history.

(56) References Cited

U.S. PATENT DOCUMENTS 4,716,754 A * 1/1988 Youngs ..... 72/178
4,787,232 A * 11/1988 Hayes ..... 72/176
5,829,294 A * 11/1998 Bradbury et al. ..... 72/176
6,148,654 A * 11/2000 Jensen et al. ..... 72/181
6,434,994 B2 * 8/2002 Bradbury et al. ..... 72/178
7,004,001 B2 * 2/2006 Barnes ..... 72/181

* cited by examiner

*Primary Examiner*—Daniel C. Crane
(74) *Attorney, Agent, or Firm*—Troxell Law Office, PLLC

(57) ABSTRACT

Disclosed is a roll-forming machine formed of a machine base and pairs of forming roll sets for the formation of a C-shaped component or a Z-shaped component from a sheet material, the two forming roll sets of each pair being symmetrically disposed at left and right sides on the machine base such that a gap is defined between the two impression wheels and two sheet-transfer wheels of each pair of forming roll sets for easy performance of maintenance work. The shaft-forming wheels of the forming roll sets of the 1$^{st}$ and 4$^{th}$ pairs are mounted with a respective locating block for easy rotation through 180° between two positions and selectively locking in one of the two positions by a respective locating rod to set the roll-forming machine for processing C-shaped component or Z-shaped component.

5 Claims, 22 Drawing Sheets

ROLL-FORMING MACHINE

BACKGROUND AND SUMMARY OF THE INVENTION

The present invention relates to a roll-forming machine and more particularly, to an improved structure of roll-forming machine, which is practical for the formation of a C-shaped component or a Z-shaped selectively. And, which facilitates the performance of maintenance and repair works.

Many roll-forming machines are known and used to transform a planar sheet of metal into a component having either a C-shaped or Z-shaped cross-sectional area. U.S. Pat. No. 6,216,514 B1 is a typical one of these designs. This design, as shown in FIG. 1, is still not satisfactory in function because of the following drawbacks:

1. When forming rolls 91, 92 or transferring rolls 931, 932, 941, 942 start to wear or other related component parts are damaged, locating members 951, 952, gears 981, 982, axle sleeve means 971, 972, 973, 974 and shaft members 981, 982 must be detached, so that the repair or replacement work can be started. After the repair or replacement work, the detached component parts must be installed again, that is, much labor and time are wasted during a repair or replacement work.
2. The left-side and right-side telescoping arbor assemblies that support the forming rolls 91, 92 are adjustable so that the lateral distance between the forming rolls 91, 92 may be adjusted. However, the forming rolls 91, 92 are not adjustable vertically to fit sheet materials of different thickness to facilitate the formation of C-shaped components/Z-shaped components of different specifications.

The present invention has been accomplished under the circumstances in view. It is therefore the main object of the present invention to provide a roll-forming machine, which eliminates the aforesaid drawbacks.

According to one aspect of the present invention, a sufficient partition space is provided between the forming roll sets at the left side of the machine base and the forming roll sets at the right side of the machine base for easy performance of maintenance and repair works. When the impression wheels or sheet-transfer wheels of the forming roll sets of the roll-forming machine are worn with a long use or damaged, the workers can easily unfasten the respective fastening members from the impression wheels or sheet-transfer wheels and the respective shafts and remove the impression wheels or sheet-transfer wheels from the respective shafts for repair or replacement.

According to another aspect of the present invention, the wheel shafts of the shape-forming wheels of the $1^{st}$ and $4^{th}$ pairs of forming roll sets are respectively mounted with a respective locating block through which the respective wheel shafts can be rotated through 180° between two positions and locked by a respective locating rod, setting the roll-forming machine for processing C-shaped component or Z-shaped component.

According to still another aspect of the present invention, the pitch between the first left-side carrier plate and the first right-side carrier plate and the pitch between the second left-side carrier plate and the second right-side carrier plats that carry the forming roll sets are adjustable for processing different sizes of C-shaped components or Z-shaped components.

DETAILED DESCRIPTION OF THE INVENTION

Referring to FIGS. 2~29, a roll-forming machine in accordance with the present invention is shown adapted to facilitate the formation of either a C-shaped component or a Z-shaped component selectively from a sheet of material. The roll-forming machine comprises a guide block unit 1 provided at the front top side of the machine base 2 thereof for guiding a sheet material 80 to the machine base 2 for processing, and pairs of forming roll sets 3.

Figure 12:
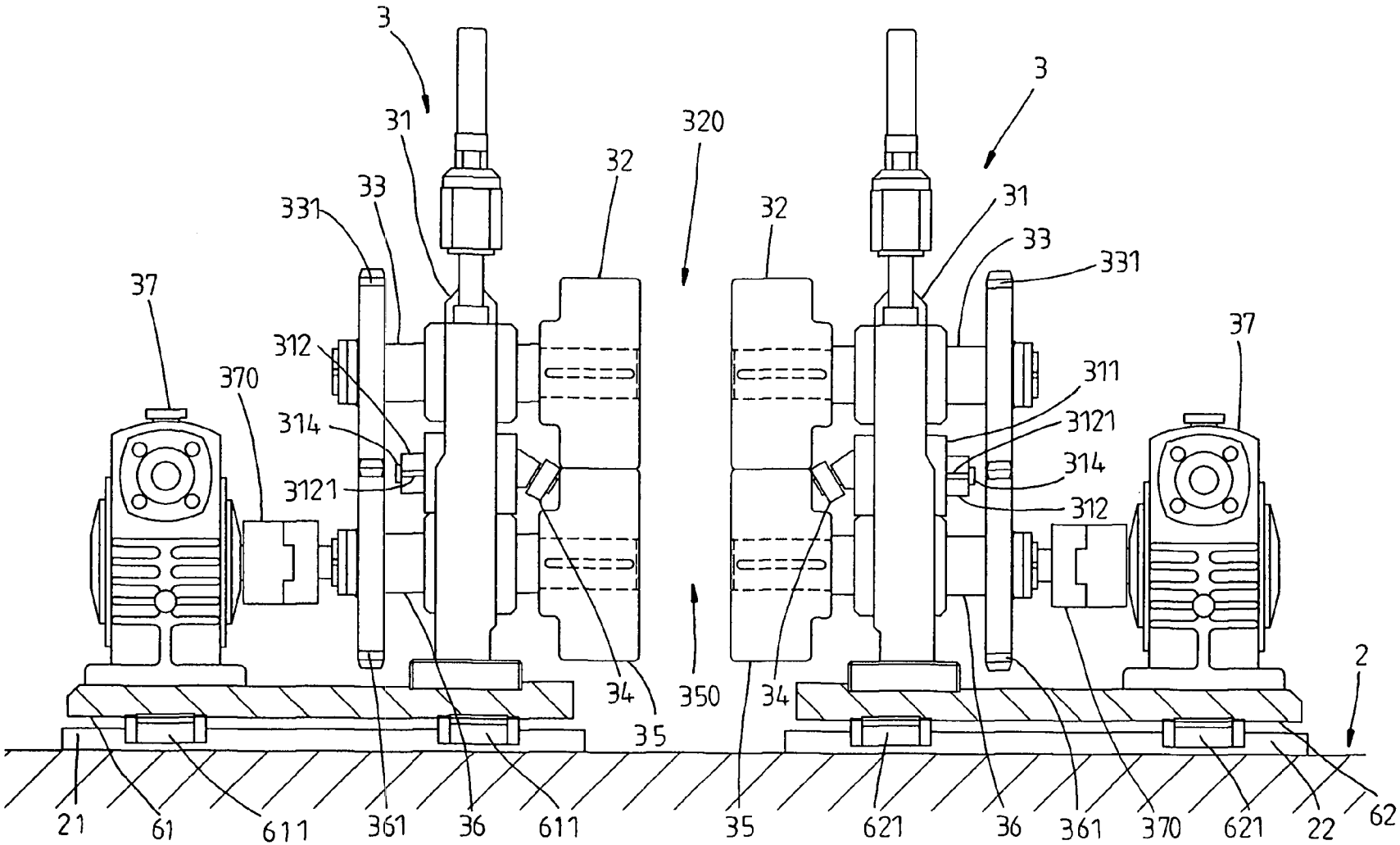
FIG. 12 is a schematic sectional of a part of the roll-forming machine according to the present invention.
Figure 13:
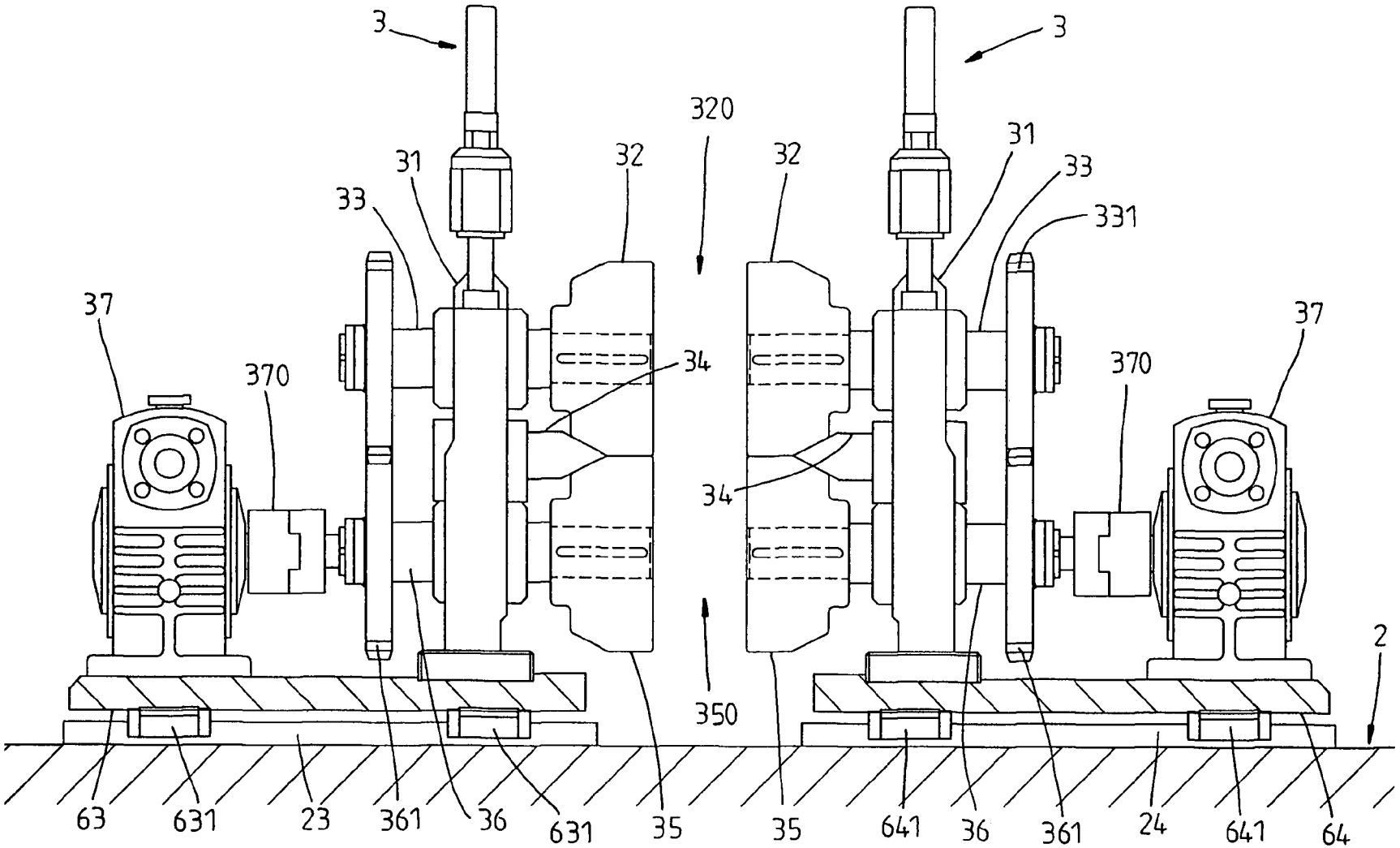
FIG. 13 corresponds to FIG. 12 but viewed from another side.
Figure 14:
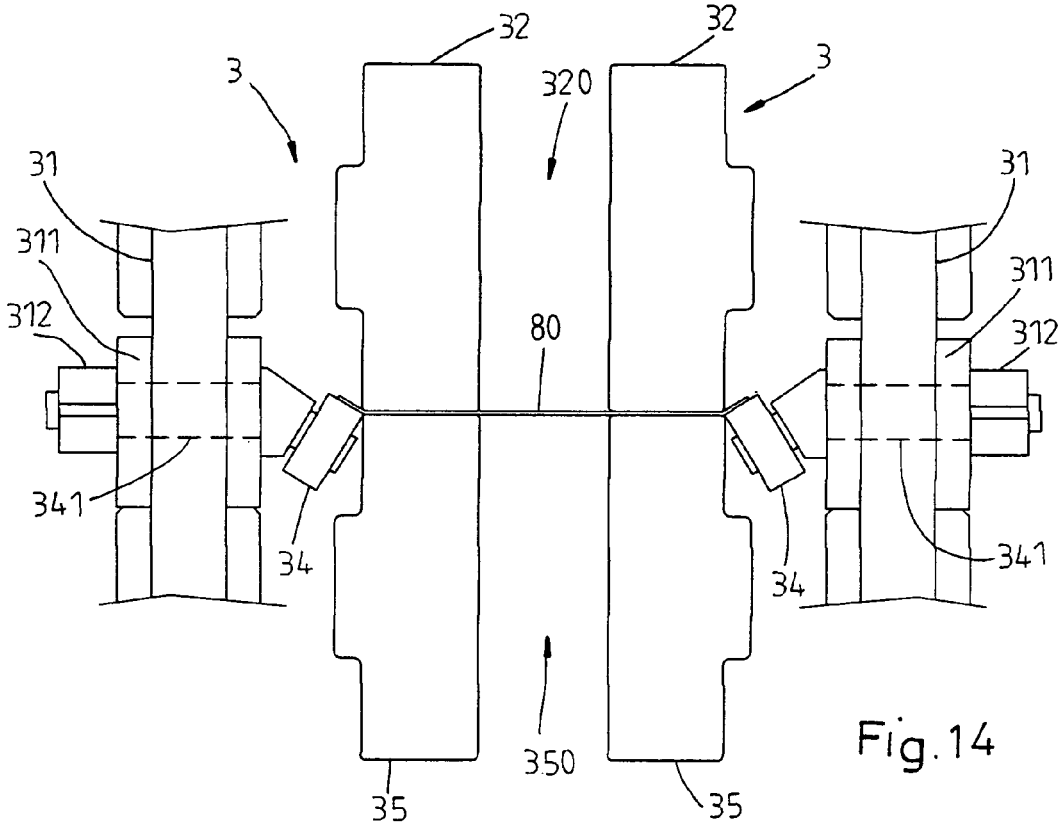
FIG. 14 is a schematic top plain view showing the sheet material rammed by the first pair of forming roll sets according to the present invention (I).
Figure 15:
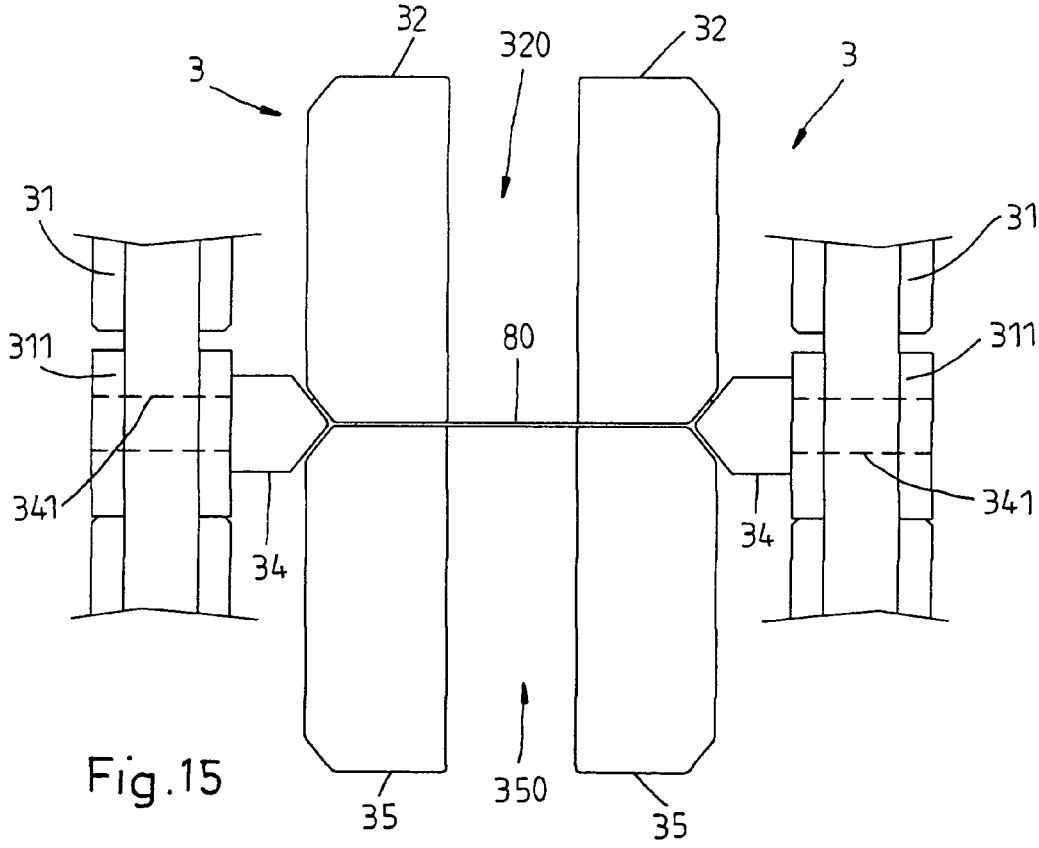
FIG. 15 is a schematic top plain view showing the sheet material rammed by the first pair of forming roll sets according to the present invention (II)
Figure 16:
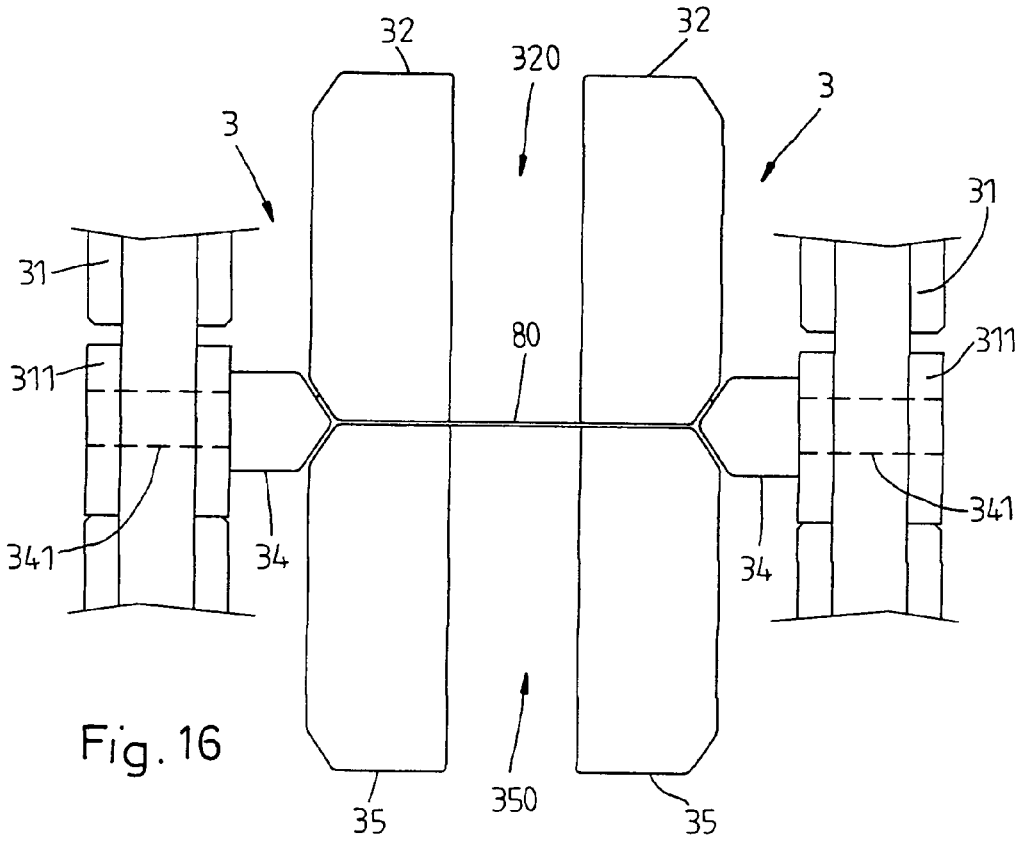
FIG. 16 is schematic top plain view showing the sheet material rammed by the first pair of forming roll sets according to the present invention (III)
Figure 17:
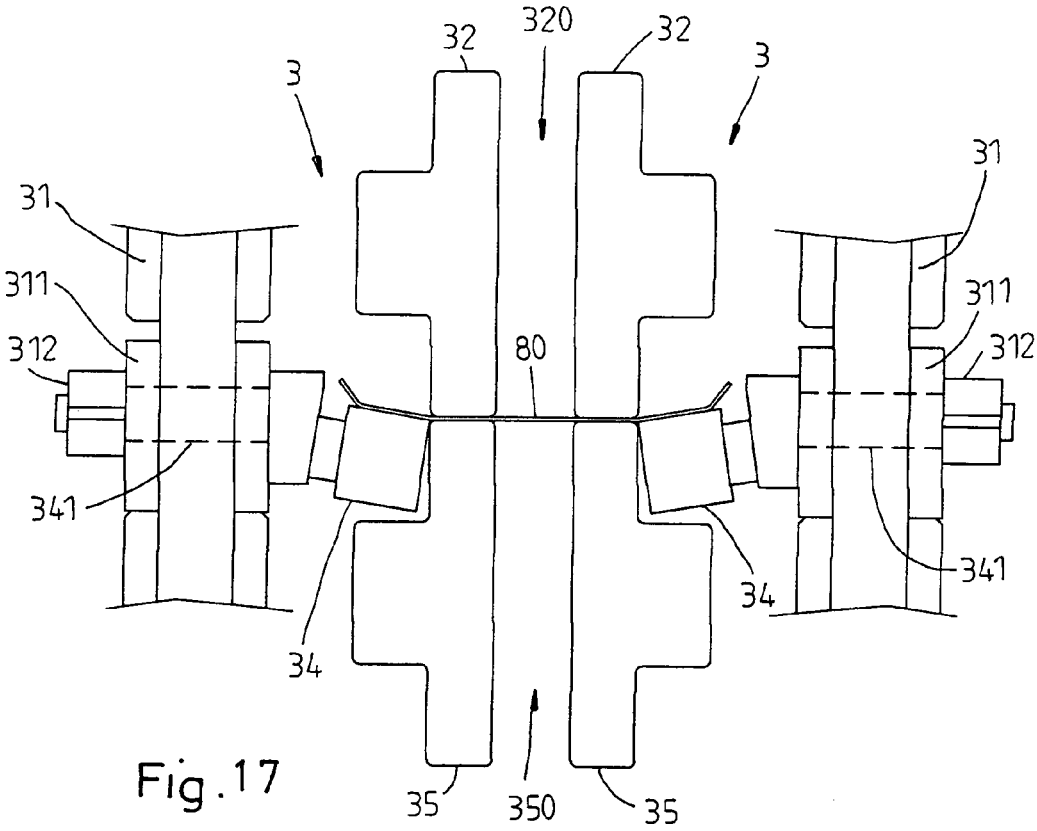
FIG. 17 is schematic top plain view showing the sheet material rammed by the first pair of forming roll sets according to the present invention (IV).
Figure 18:
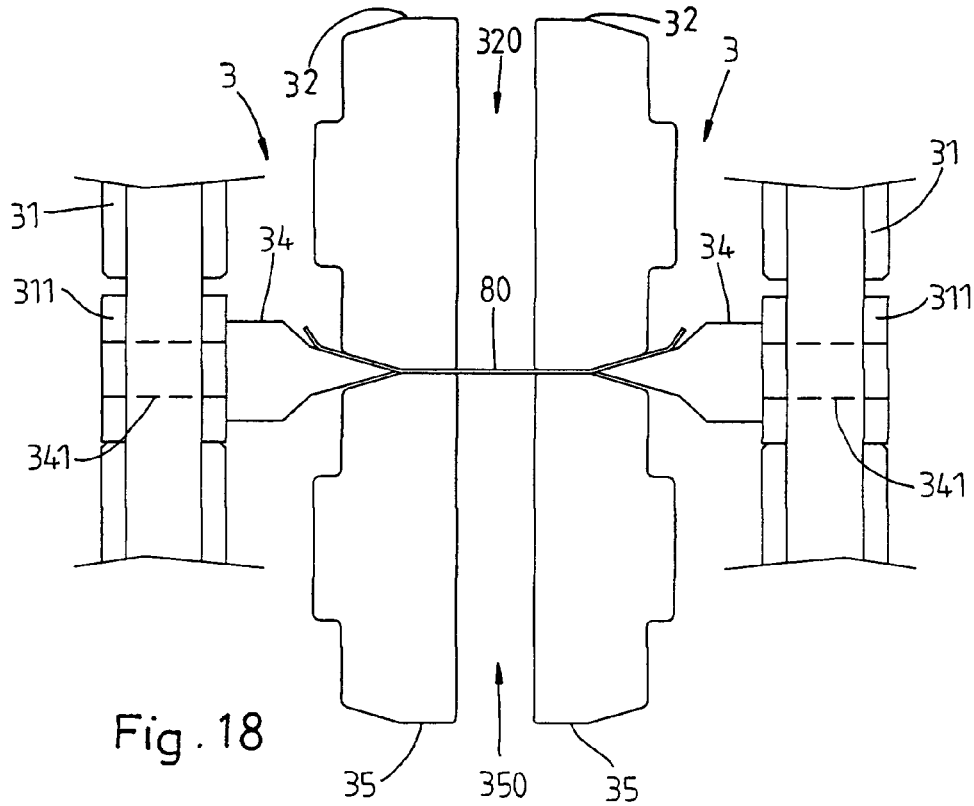
FIG. 18 is schematic top plain view showing the sheet material rammed by the first pair of forming roll sets according to the present invention (V).
Figure 19:
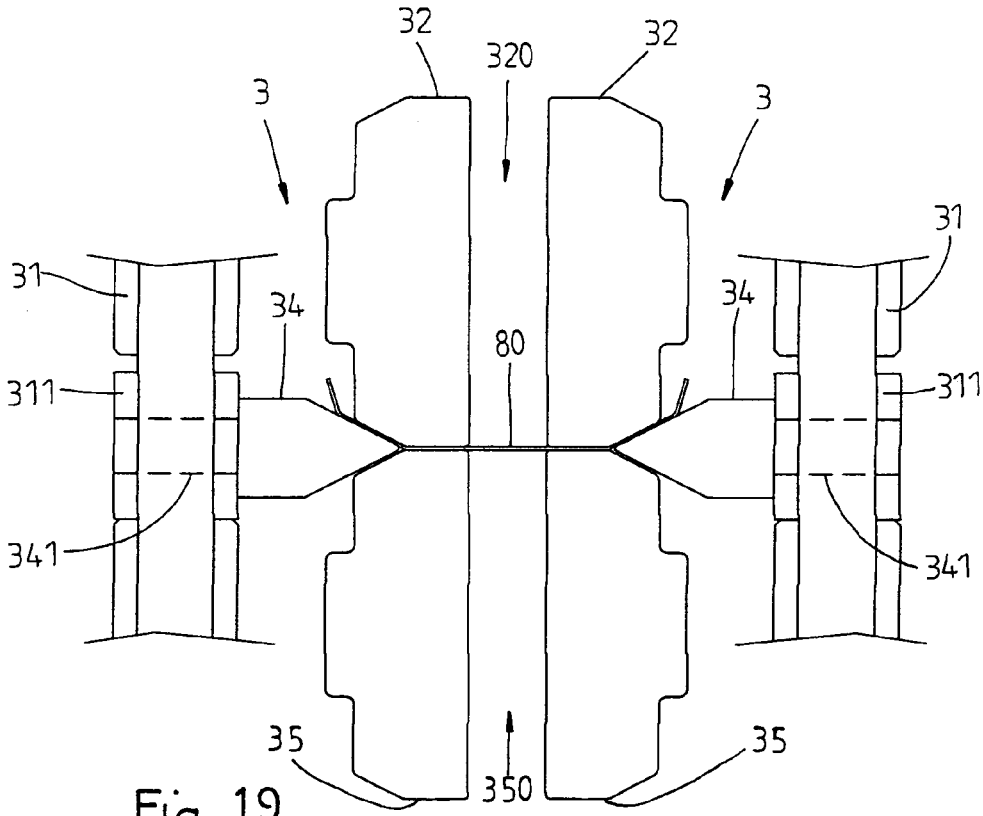
FIG. 19 is schematic top plain view showing the sheet material rammed by the first pair of forming roll sets according to the present invention (VI).
Figure 20:
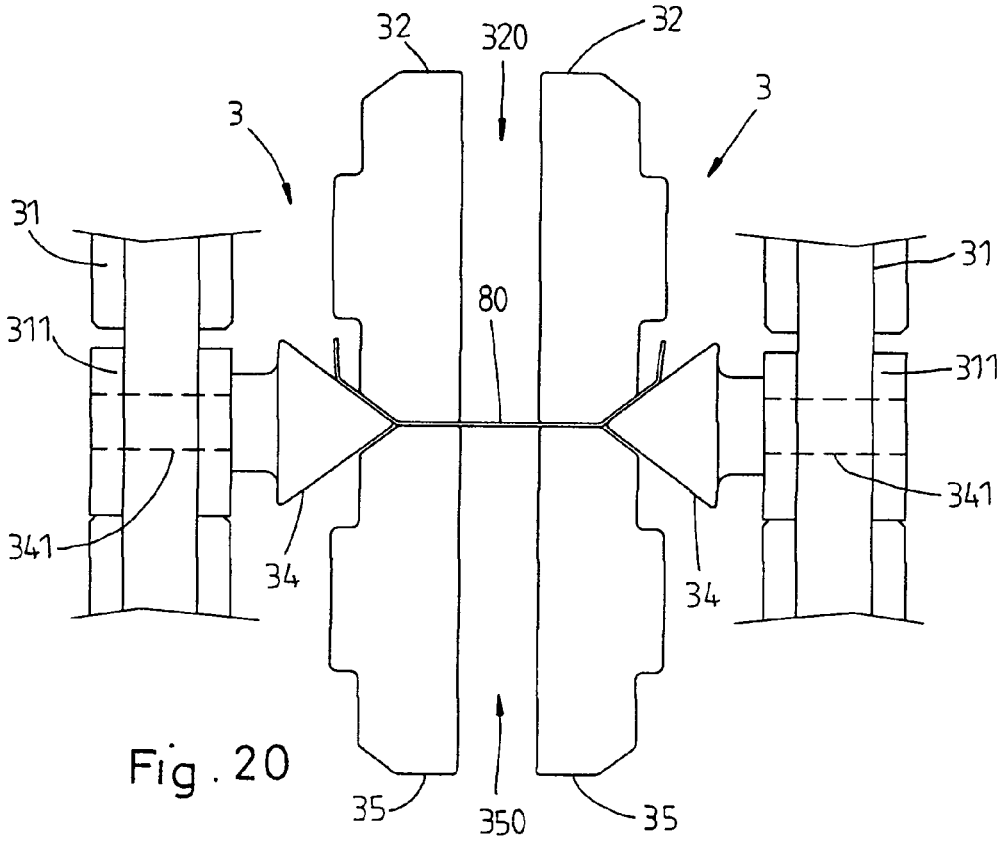
FIG. 20 is schematic top plain view showing the sheet material rammed by the first pair of forming roll sets according to the present invention (VII).
Figure 21:
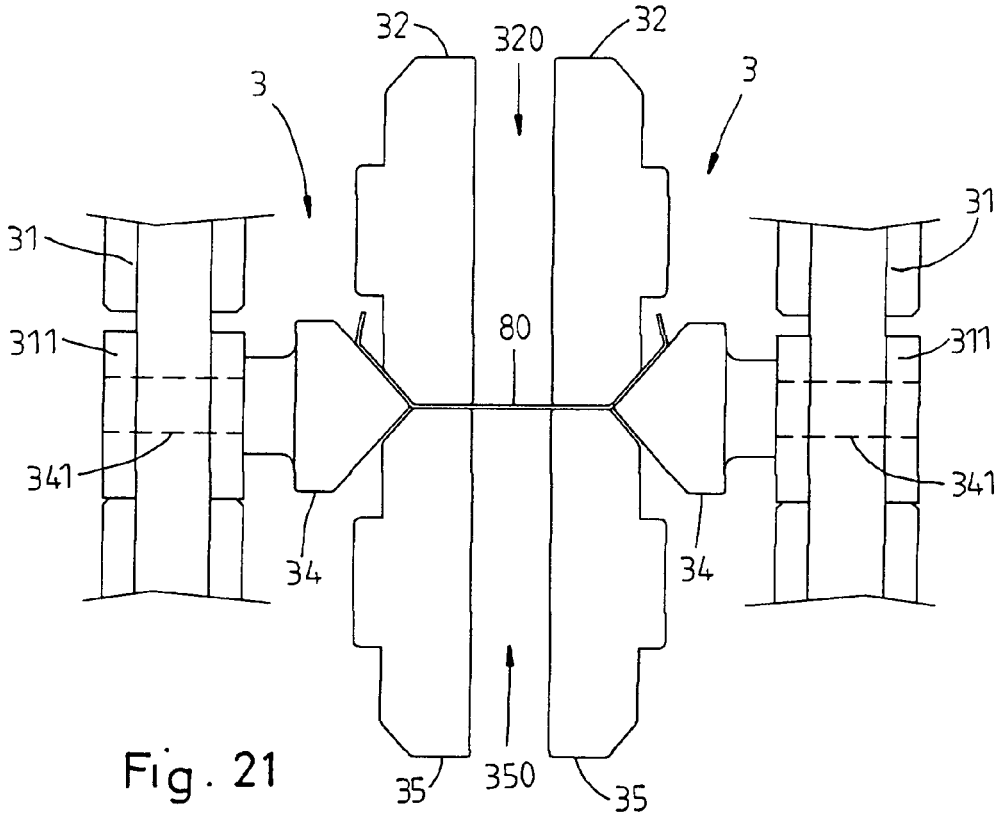
FIG. 21 is schematic top plain view showing the sheet material rammed by the first pair of forming roll sets according to the present invention (VIII).
Figure 22:
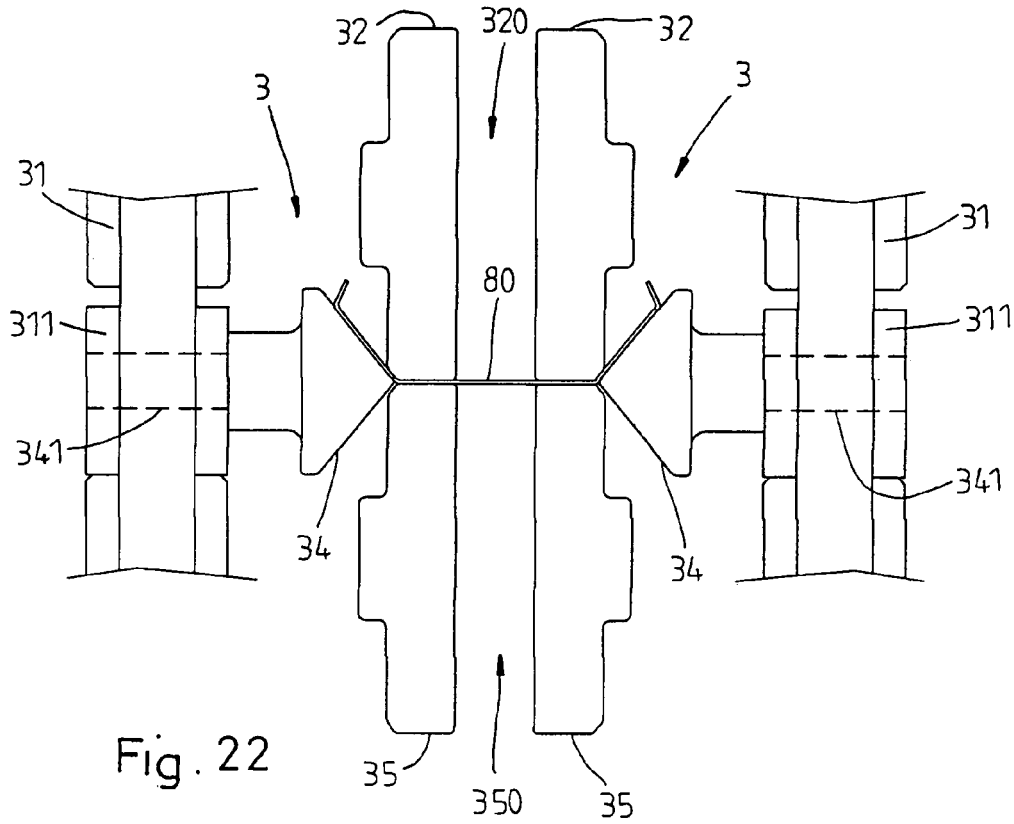
FIG. 22 is schematic top plain view showing the sheet material rammed by the first pair of forming roll sets according to the present invention (IX).
Figure 23:
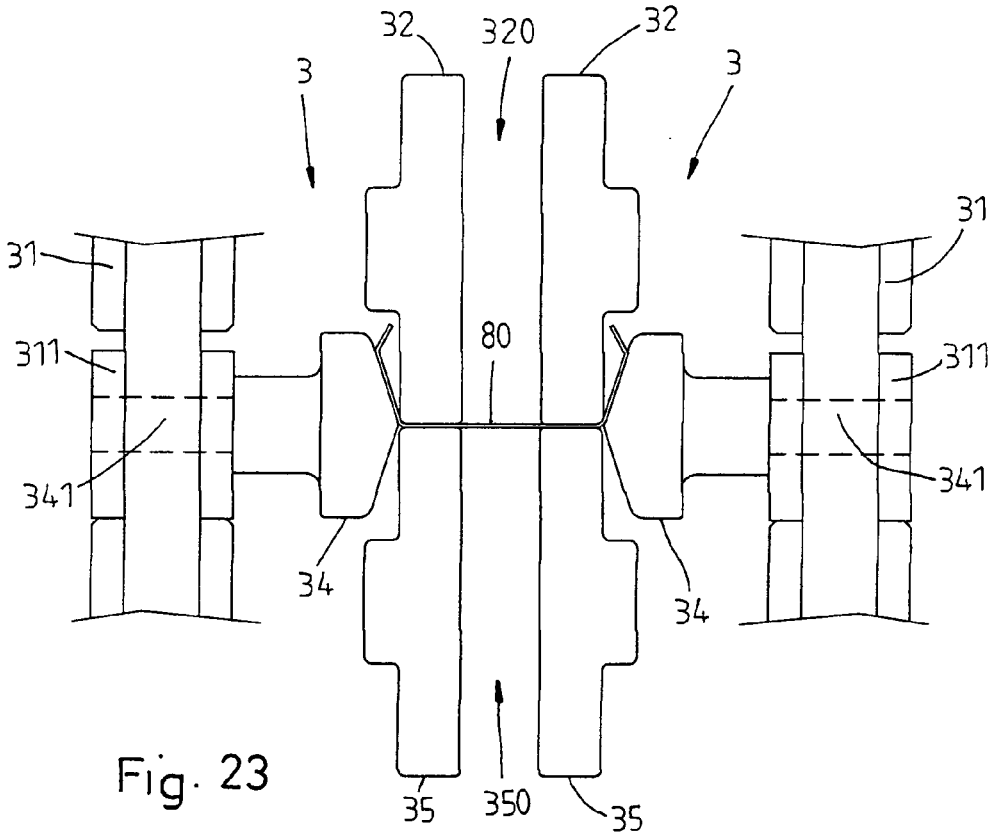
FIG. 23 is schematic top plain view showing the sheet material rammed by the first pair of forming roll sets according to the present invention (X).
Figure 24:
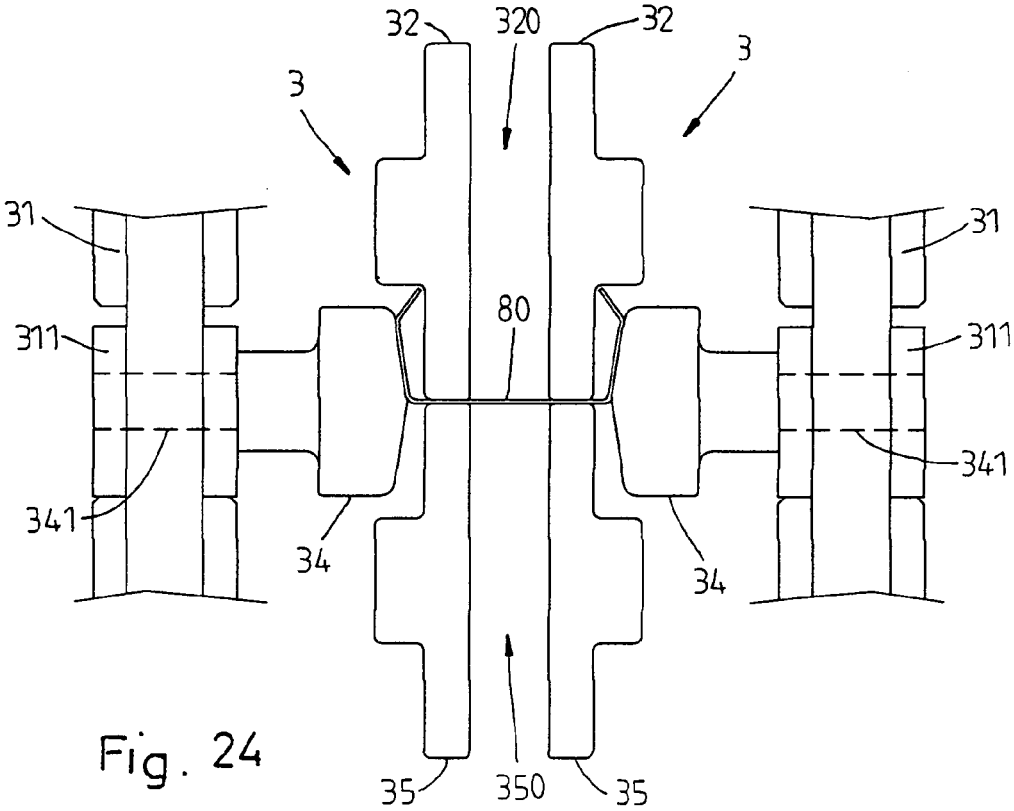
FIG. 24 is schematic top plain view showing the sheet material rammed by the first pair of forming roll sets according to the present invention (XI).
Figure 25:
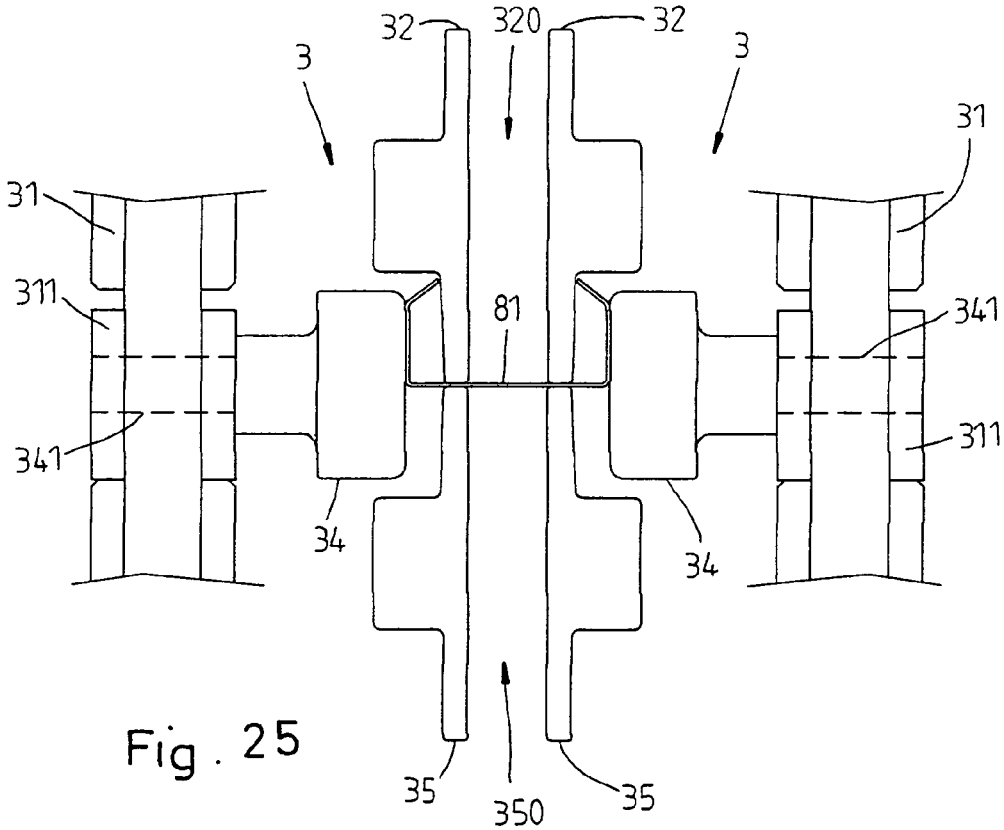
FIG. 25 is schematic top plain view showing the sheet material rammed by the first pair of forming roll sets according to the present invention (XII).
Figure 26:
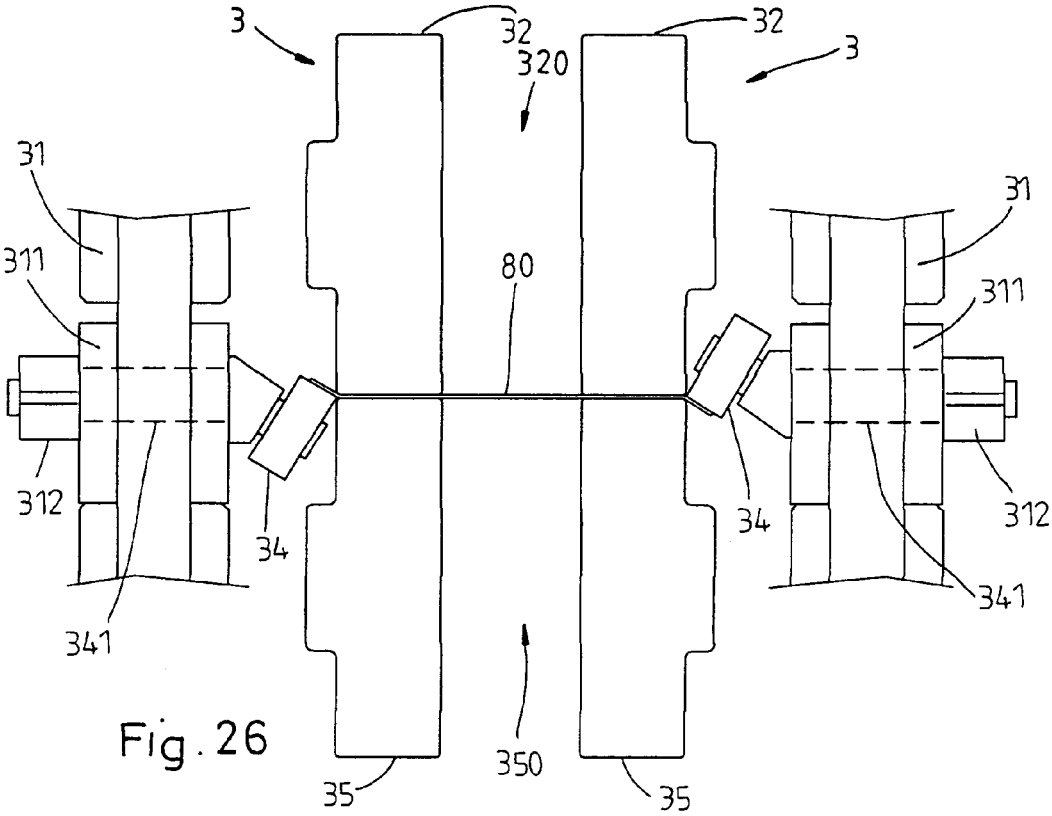
FIG. 26 is schematic top plain view showing the shape-forming wheel of one of the $1^{st}$ pair of forming roll sets rotated through 180° and the sheet material rammed.
Figure 27:
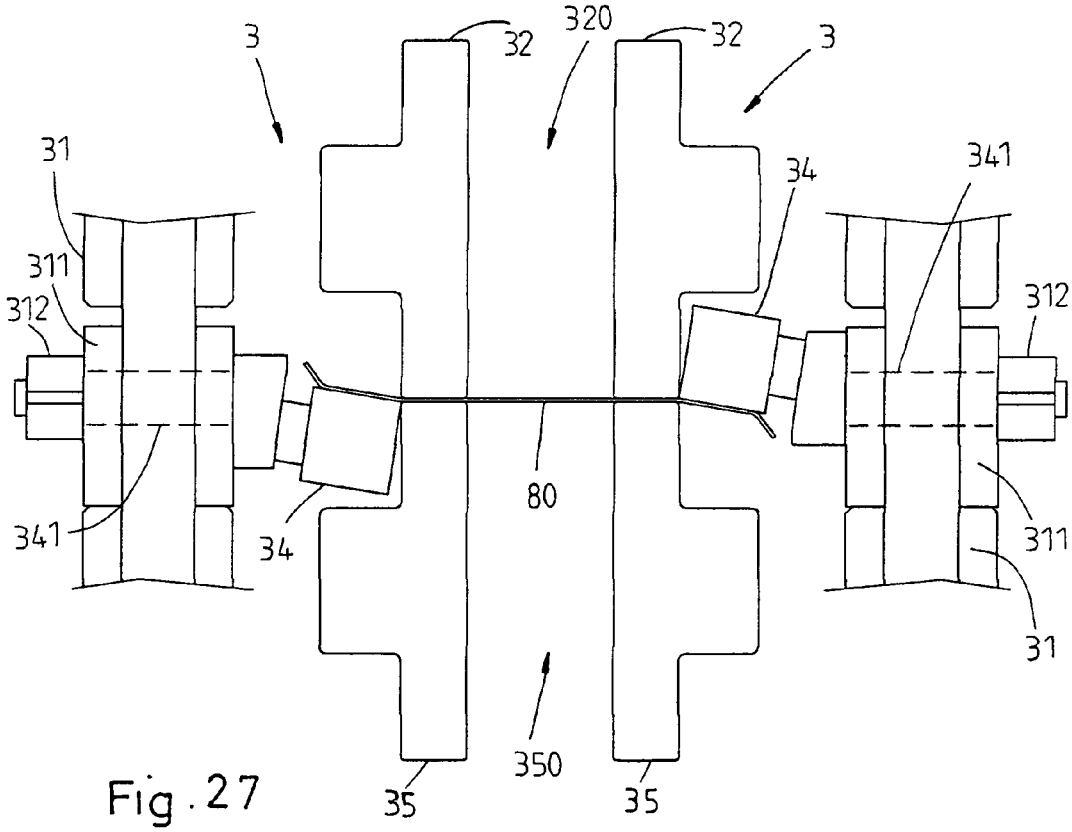
FIG. 27 is schematic top plain view showing the shape-forming wheel of one of the $4^{th}$ pair of forming roll sets rotated through 180° and the sheet material rammed.
Figure 28:
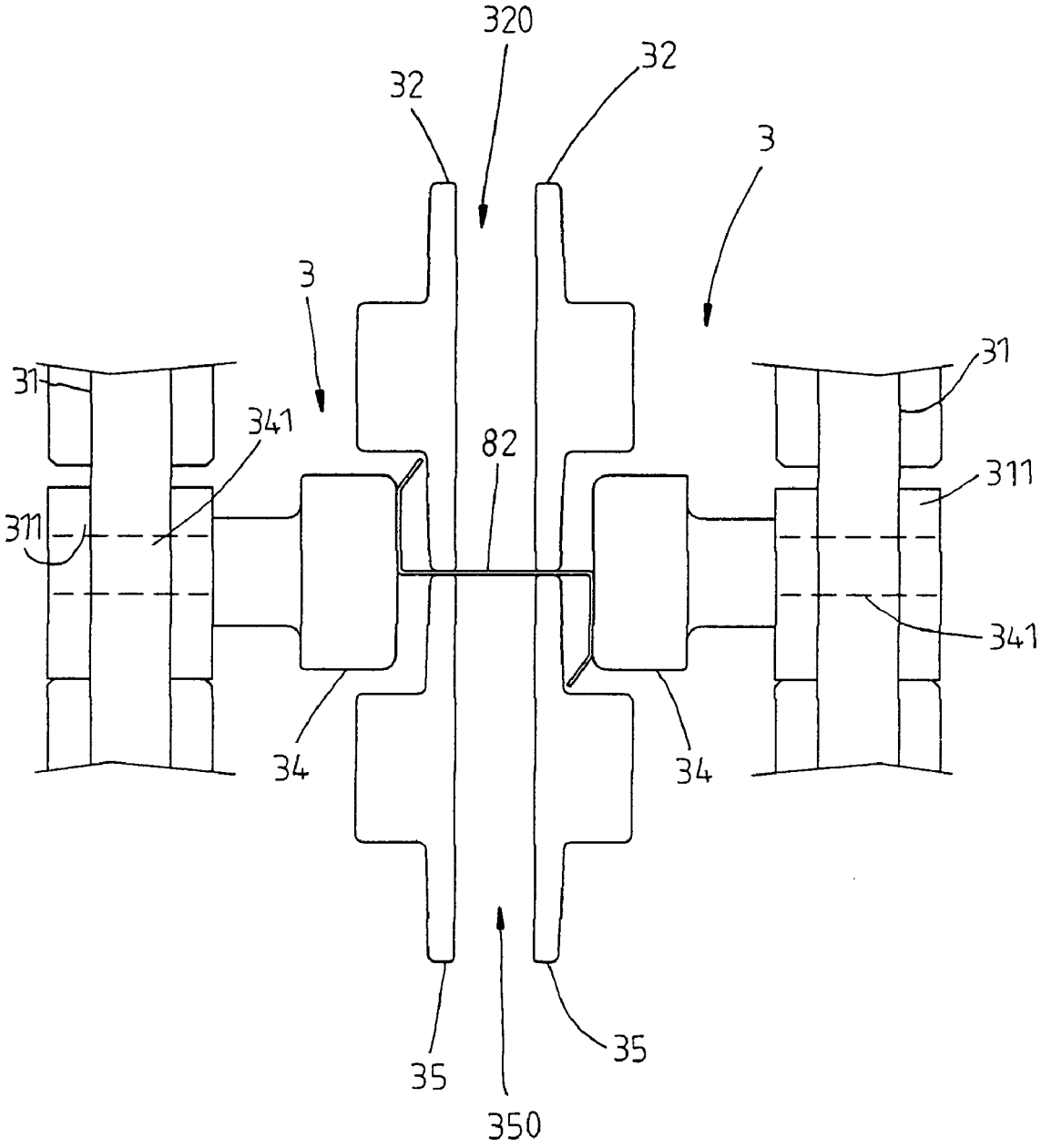
FIG. 28 is a schematic drawing showing the formation of a Z-shaped component from the sheet material at the $12^{th}$ pairs of forming roll sets according to the present invention.

The number of the pairs of forming roll sets 3 is 15 numbered from the 1st through the 15th. As shown in FIG. 12, each forming roll set 3 comprises a rack 31, a first shaft 33 and a second shaft 36 pivotally mounted in the rack 31 in horizontal at different elevations, an impression wheel 32 fixedly mounted on one end of the first shaft 33, a first gear wheel 331 fixedly mounted on the other end of the first shaft 33, a sheet-transfer wheel 35 fixedly mounted on one end of the second shaft 36 corresponding to the impression wheel 32, a second gear wheel 361 fixedly mounted on the other end of the second shaft 36 and meshed with the first gear wheel 331, a shape-forming wheel 34, which has a wheel shaft 341 pivotally mounted in a wheel holder 311 at the rack 31 and is adapted to ram the sheet material 80 being delivered through the gap between the impression wheel 32 and the sheet-transfer wheel 35 into a predetermined shape (see FIGS. 8 and 14), a reduction gear box 37, and a coupling 370 coupled between the output side of the reduction gear box 37 and the second shaft 36. Upon rotation of the second shaft 36 by the reduction gear box 37 through the coupling 370, the sheet-transfer wheel 35 and the second gear wheel 361 are rotated with the second shaft 36, and the first gear wheel 331 is driven by the second gear wheel 361 to rotate the first shaft 33 and the impression wheel 32.

The roll-forming machine further comprises two motors 38 adapted to drive the reduction gear boxes 37 of the forming roll sets 3, a first bottom auxiliary shape-forming wheel set 41 set between the $10^{th}$ pair of forming roll sets 3 and the $11^{th}$ pair of forming roll sets 3 (see FIG. 4) and adapted to ram the bottom part of the processed sheet material 80 into a 90° contained angle, a second bottom auxiliary shape-forming wheel set 42 set between the $11^{th}$ pair of forming roll sets 3 and the $12^{th}$ pair of forming roll sets 3 and adapted to ram each of the two sides of the bottom part of the processed sheet material 80 into a 90° contained angle, a top auxiliary shape-forming wheel set 43 set between the $12^{th}$ pair of forming roll sets 3 and the $13^{th}$ pair of forming roll sets 3 and adapted to ram each of the two sides of the top part of the processed sheet material 80 into a 90° contained angle, a small straightener 51 set between the $13^{th}$ pair of forming roll sets 3 and the $14^{th}$ pair of forming roll sets 3 and adapted to straighten the wall of the processed sheet material 80, and a big straightener 52 set at the rear side of the machine base 2 and adapted to straighten the wall of the finished C-shaped component or Z-shaped component.

When the prepared sheet material 80 (see FIG. 4) passed through the guide block unit 1 to the machine base 2, it is immediately transferred in proper order through the impression roll 32 and sheet-transfer roll 35 of each of the forming roll sets 3, and then processed in proper order by each shape-forming wheel 34, the first bottom auxiliary shape-forming wheel set 41, the second bottom auxiliary shape-forming wheel set 42, the top auxiliary shape-forming wheel set 43, the small straightener 51 and the big straightener 52 into the desired C-shaped component 81. When the operator turned the shape-forming wheels 34 of $1^{st}$ forming roll set 3 and the $4^{th}$ forming roll set 3 through 180° to reverse the relative position between the first left-side forming roll 421 and the second left-side forming roll 422 (see FIGS. 26 and 27), the roll-forming machine can then processes the prepared sheet material 80 into a Z-shaped component 82 (see FIG. 28).

The main features of the present invention are outlined hereinafter.

The forming roll sets 3 are arranged into pairs. The two forming roll sets 3 of each pair are symmetrically disposed at two sides such that a gap 320 is defined between the two impression wheels 32 of each pair of forming roll sets 3 (see FIG. 13), and a gap 350 is defined between the two sheet-transfer wheels 35 of each pair of forming roll sets 3 (see FIG. 12). The two racks 31 of each pair of forming roll sets 3 are respectively mounted on a first left-side carrier plate 61 and second left-side carrier plate 63, and a first right-side carrier plate 62 and second right-side carrier plate 64. The first left-side carrier plate 61 and the first right-side carrier plate 62 have the respective bottom side respectively mounted with slides 611, 621 that are respectively coupled to a left-side rail 21 and a right-side rail 22 at the top side of the machine base 2; the second left-side carrier plate 63 and the second right-side carrier plate 64 have the respective bottom side respectively mounted with slides 631, 641 that are respectively coupled to a left-side rail 23 and a right-side rail 24 at the rear side of the machine base 2. By means of the aforesaid arrangement, a sufficient partition space is provided between the forming roll sets 3 at the left side and the forming roll sets at the right side for easy performance of maintenance and repair works. When the impression wheels 32 or sheet-transfer wheels 35 of the forming roll sets 3 are worn with a long use or damaged, the workers can easily unfasten the respective fastening members 50 from the impression wheels 32 or sheet-transfer wheels 35 and the respective shafts 33 or 36 and remove the impression wheels 32 or sheet-transfer wheels 35 from the respective shafts 33 or 36 for repair or replacement. (see FIGS. 3 and 6).

Further, the wheel holder 311 of each forming roll set 3 comprises a coupling hole 3111 (see FIG. 8) for receiving the wheel shaft 341 of the respective shape-forming wheel 34. The wheel holder 311 of one of the forming roll sets 3 has two coupling grooves 3113 horizontally arranged in parallel at two sides of the coupling hole 3111, and a locating block 312 fastened to the wheel shaft 341 of the respective shape-forming wheel 34 in the coupling hole 3111 with fastening members, for example, screw bolts 3112. The locating block 312 has two coupling grooves 3121 symmetrically disposed at two opposite lateral sides, and can be rotated with the wheel shaft 341 of the respective shape-forming wheel 34 in the coupling hole 3111 through 180° between two positions to let one coupling groove 3121 of the locating block 312 be connected to one coupling groove 3113 of the wheel holder 311 and one coupling groove 3410 of the wheel shaft 341 of the respective shape-forming wheel 34 by a locating rod 314. When the shape-forming wheel 34 of one of the $1^{st}$ pair of forming roll sets 3 and the shape-forming wheel 34 of the corresponding one of the $4^{th}$ pair of forming roll sets 3 are turned through 180°, the respective shape-forming wheels 34 at the left side and the respective shape-forming wheels 34 at the right side are asymmetric (see FIGS. 26 and 27), and the roll-forming machine is set to ram the prepared sheet material 80 into the desired Z-shaped component 82 (see FIG. 28).

Figure 1:
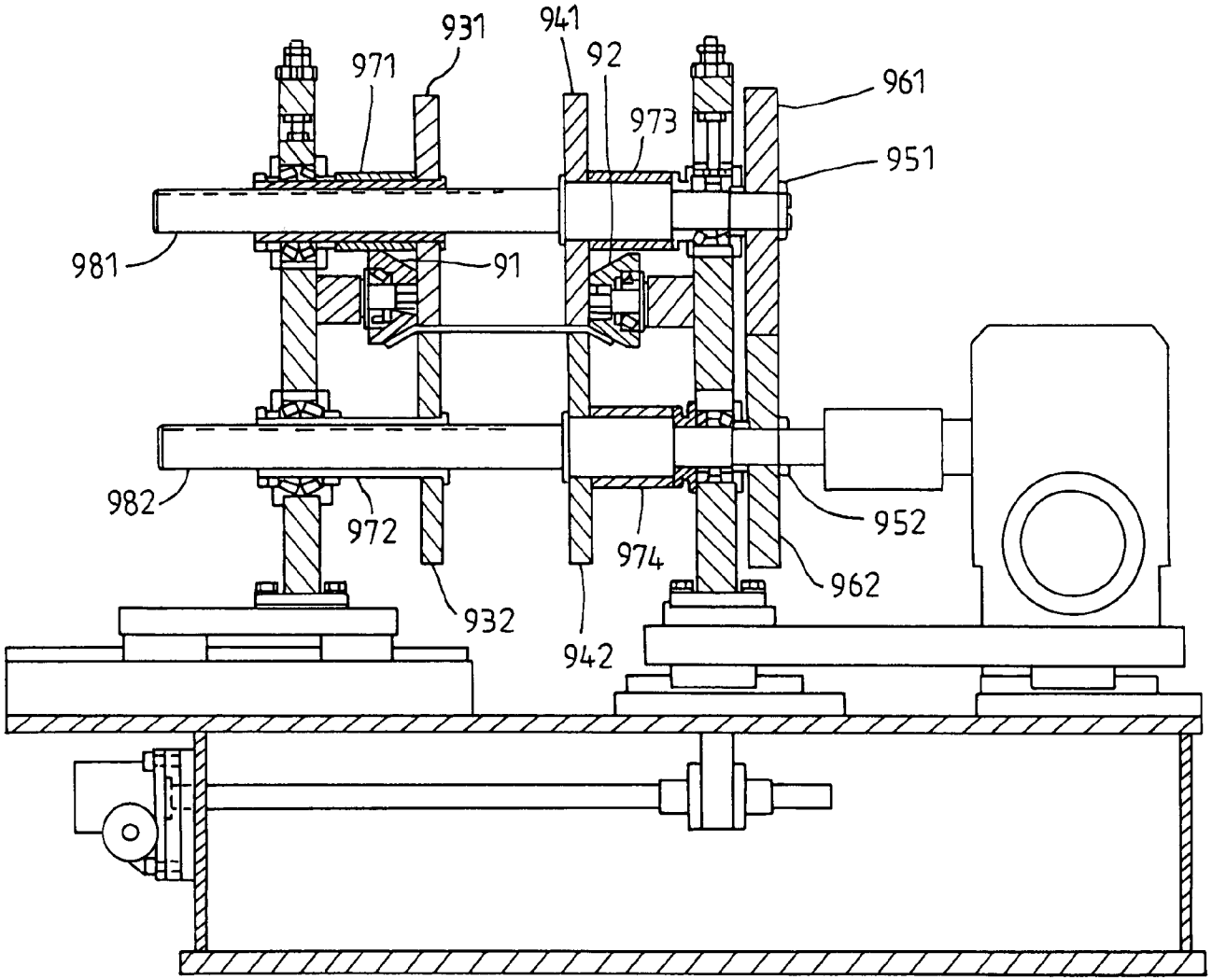
Fig 1 PRIOR ART
FIG. 1 is a plain view of a roll-forming machine according to the prior art.
Figure 2:
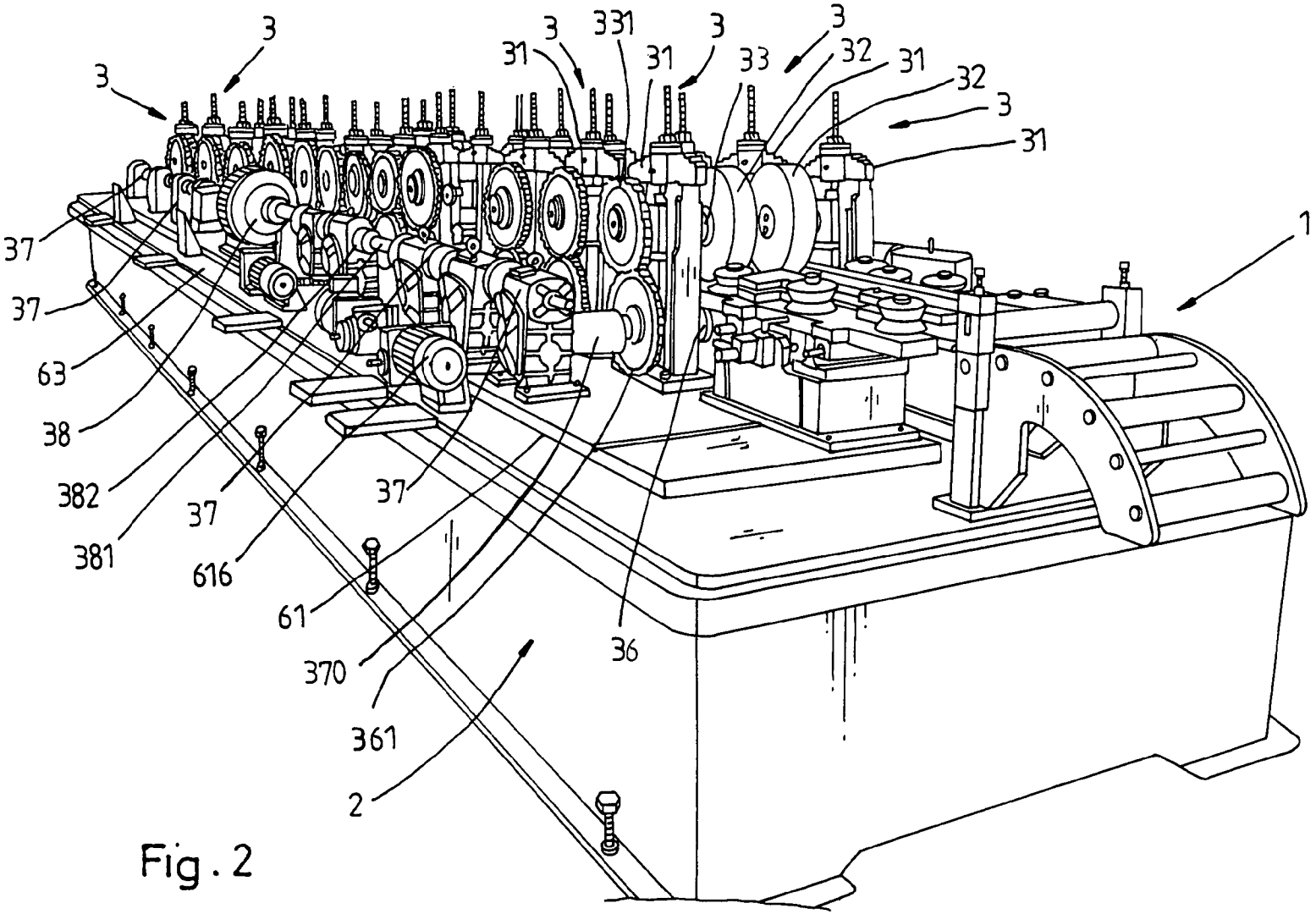
FIG. 2 is an oblique elevation of a roll-forming machine according to the present invention.
Figure 3:
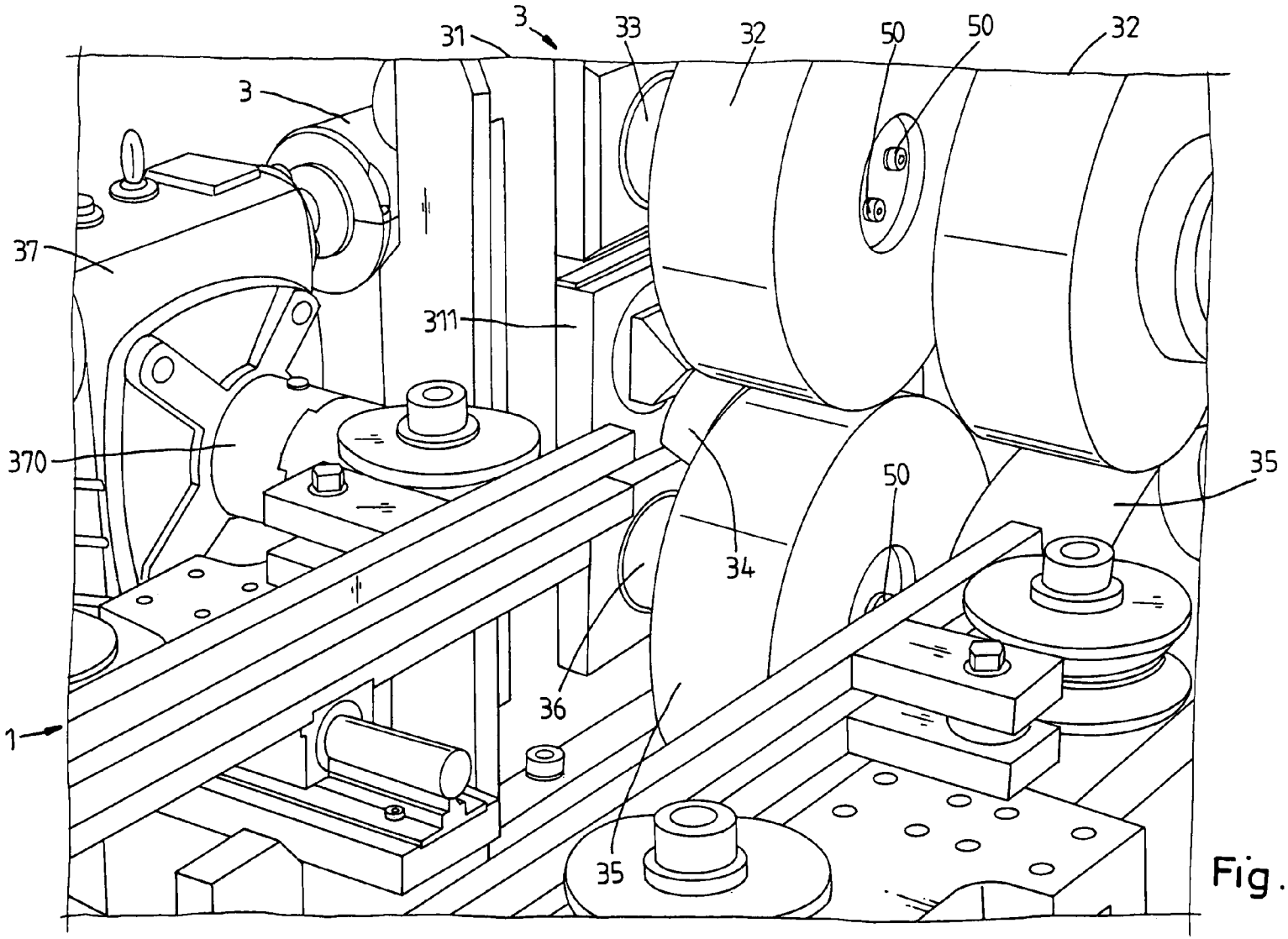
FIG. 3 is an enlarged view of a part of the roll-forming machine according to the present invention.
Figure 4:
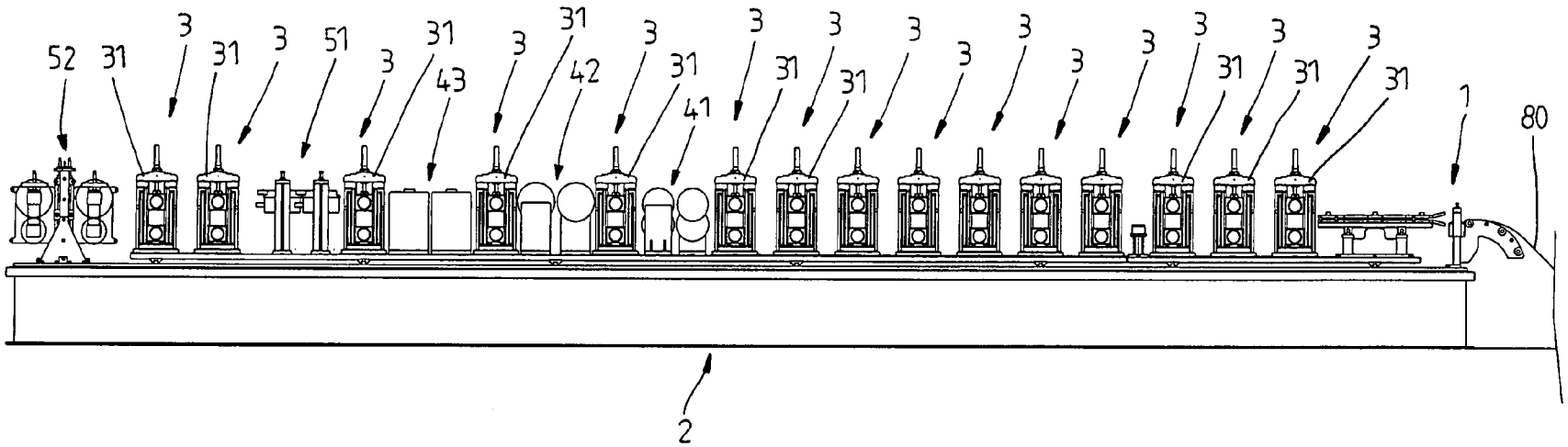
FIG. 4 is a side plain view of the roll-forming machine according to the present invention.
Figure 5:
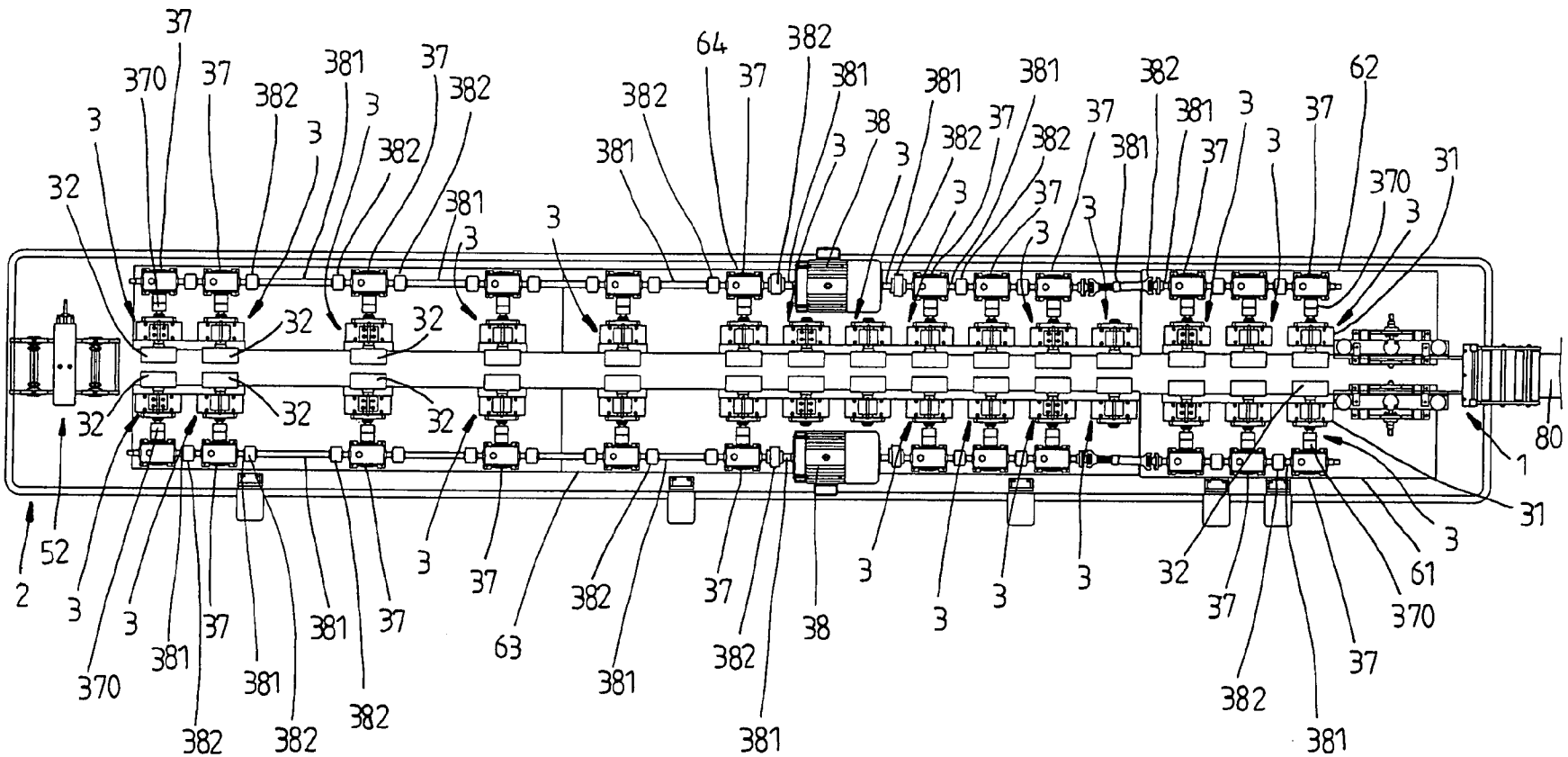
FIG. 5 is a top plain view of the roll-forming machine according to the present invention.
Figure 6:
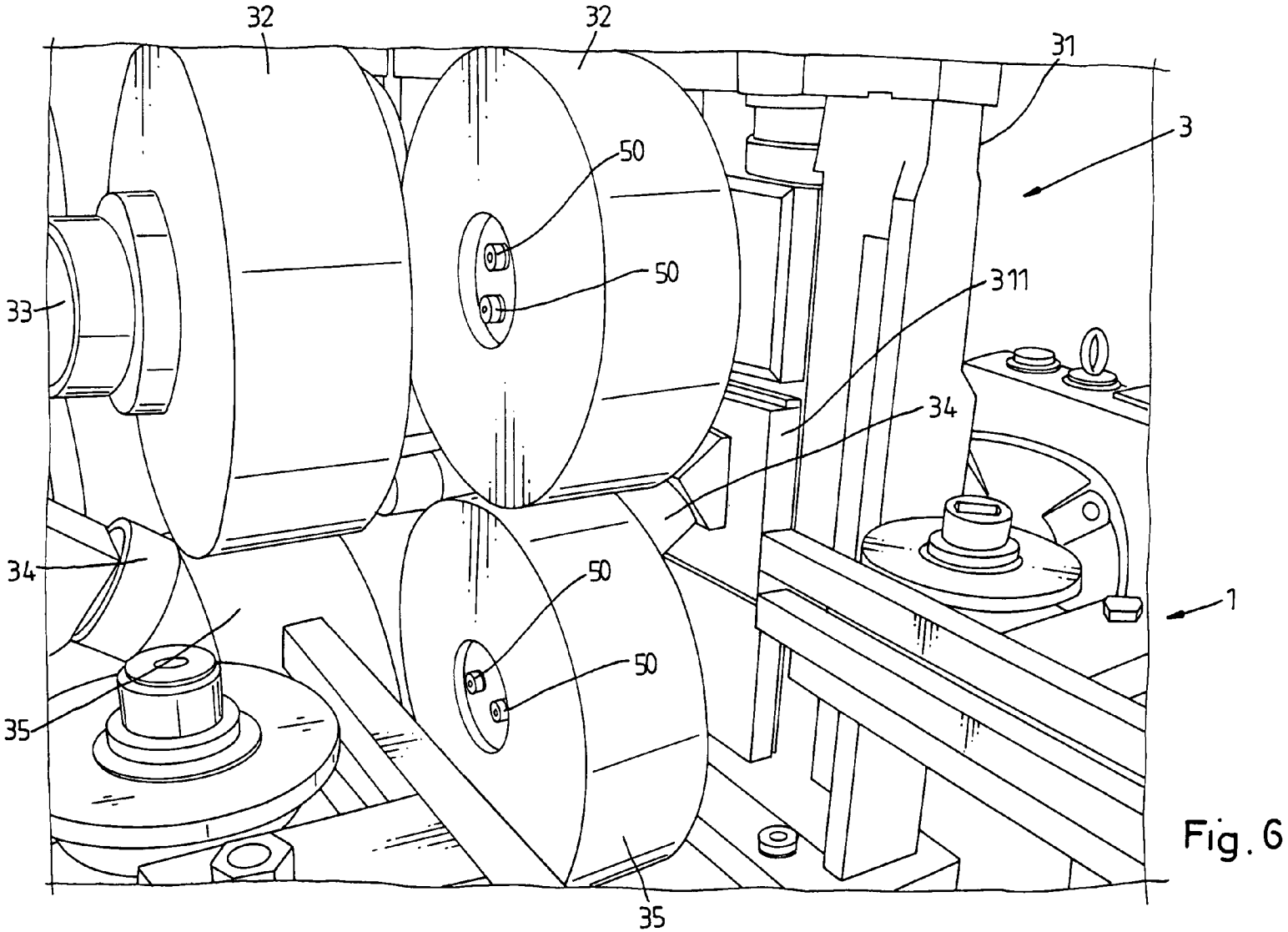
FIG. 6 is an enlarged view of another part of the roll-forming machine according to the present invention.
Figure 7:
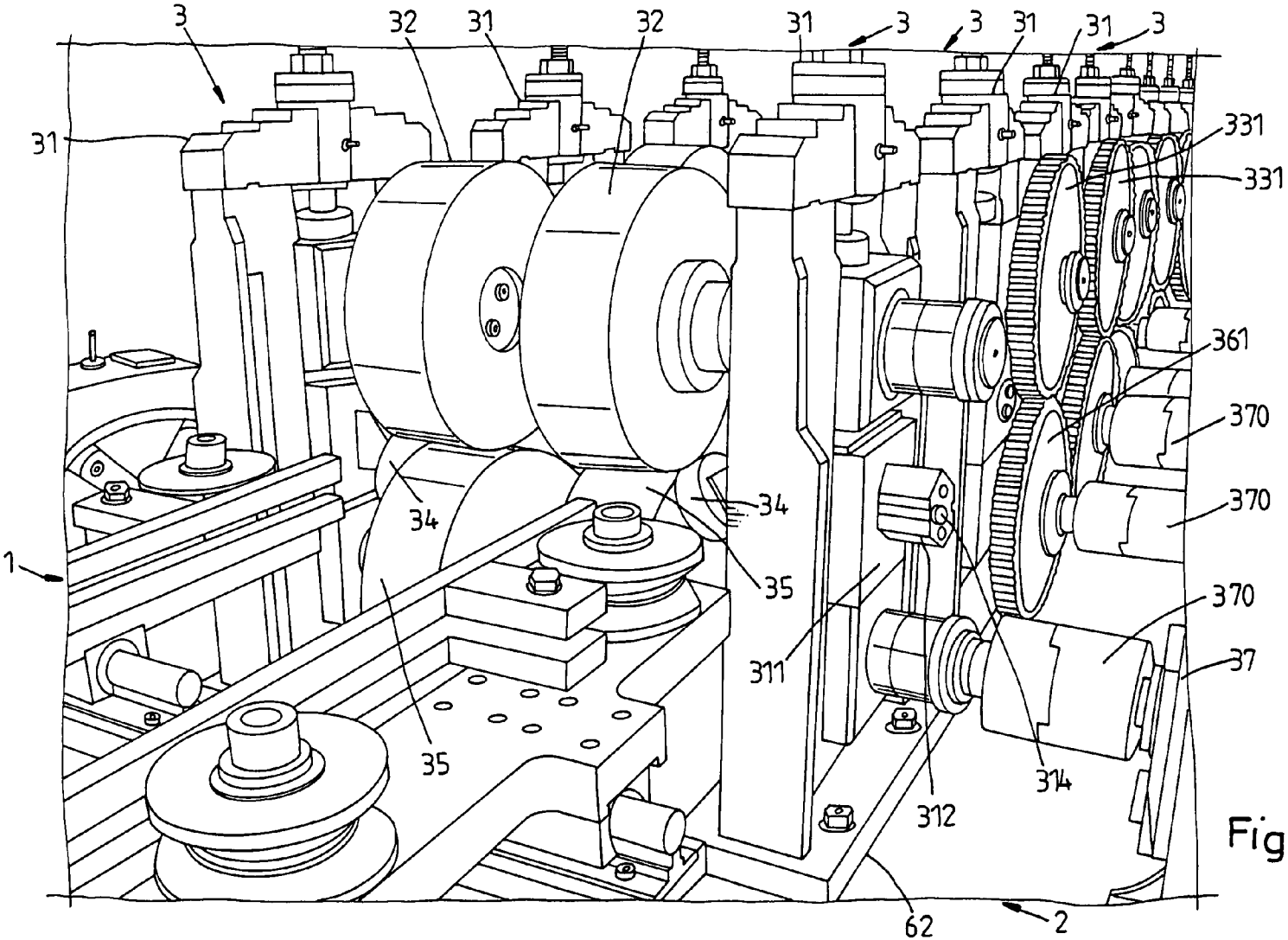
FIG. 7 is an enlarged view of still another part of the roll-forming machine according to the present invention.
Figure 8:
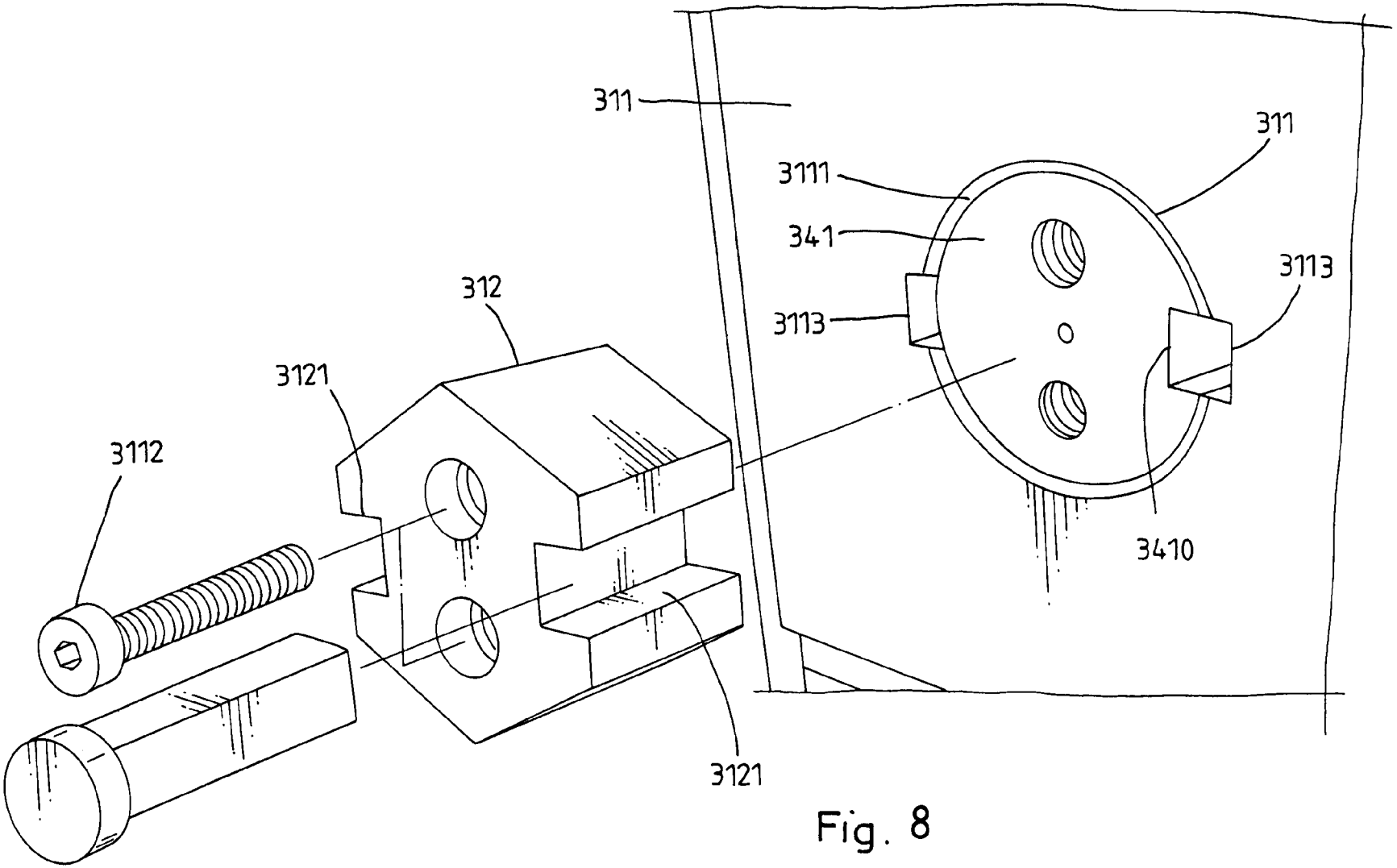
FIG. 8 is an exploded view in an enlarged scale of a part of the present invention, showing the relationship between the locating block and the wheel shaft of the shape-forming wheel.
Figure 9:
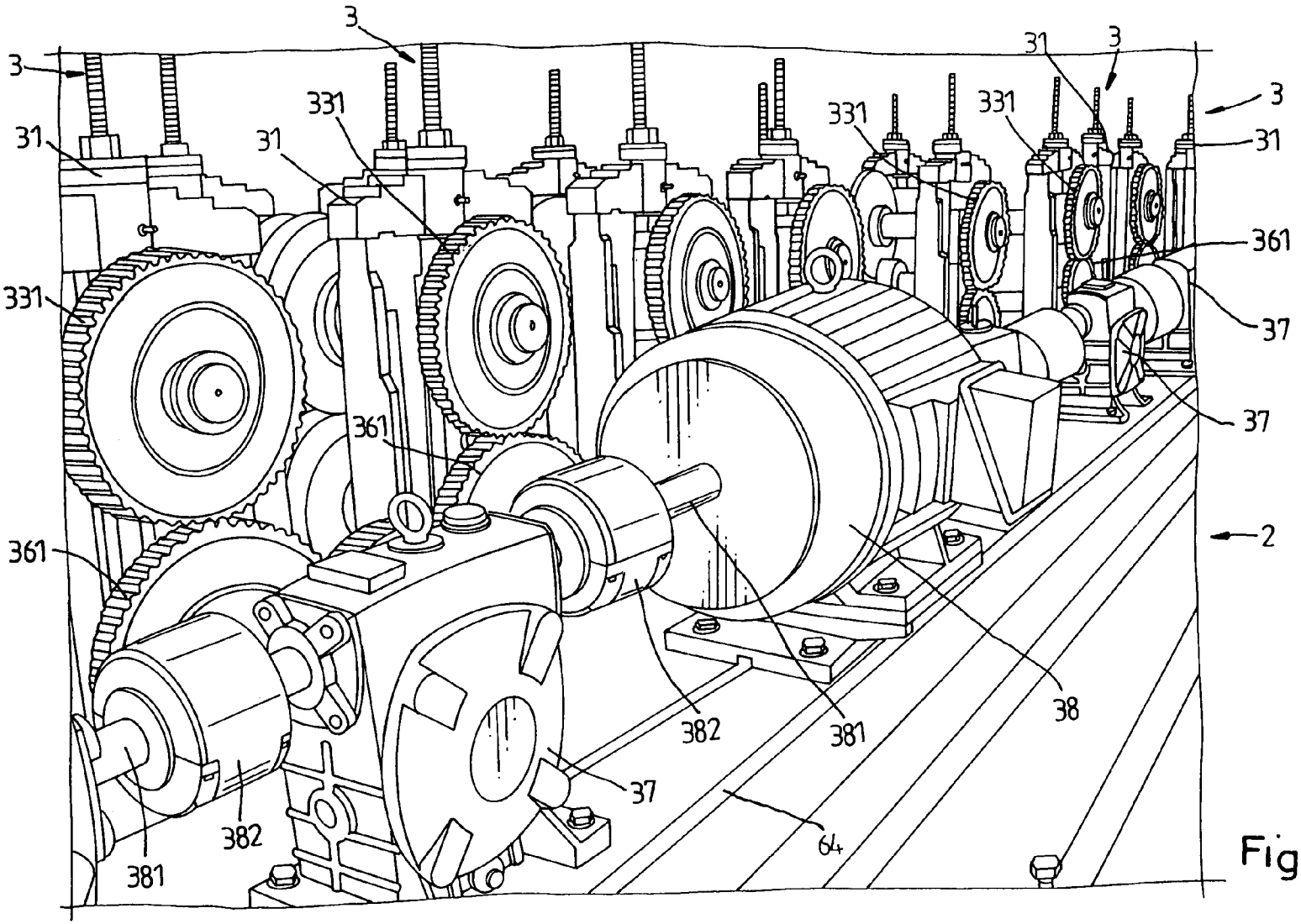
FIG. 9 is an enlarged view of still another part of the roll-forming machine according to the present invention.
Figure 10:
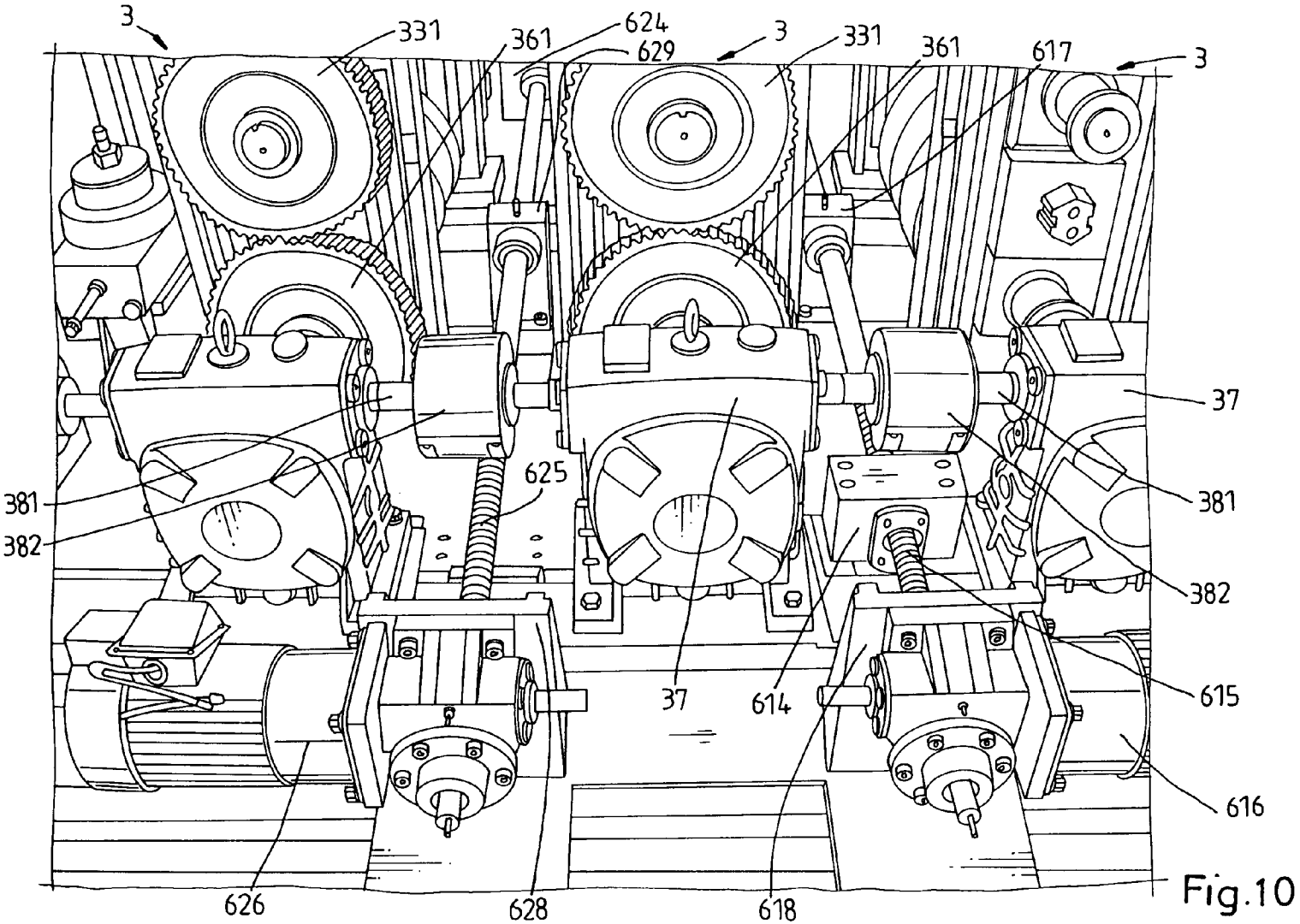
FIG. 10 is an enlarged view of still another part of the roll-forming machine according to the present invention.
Figure 11:
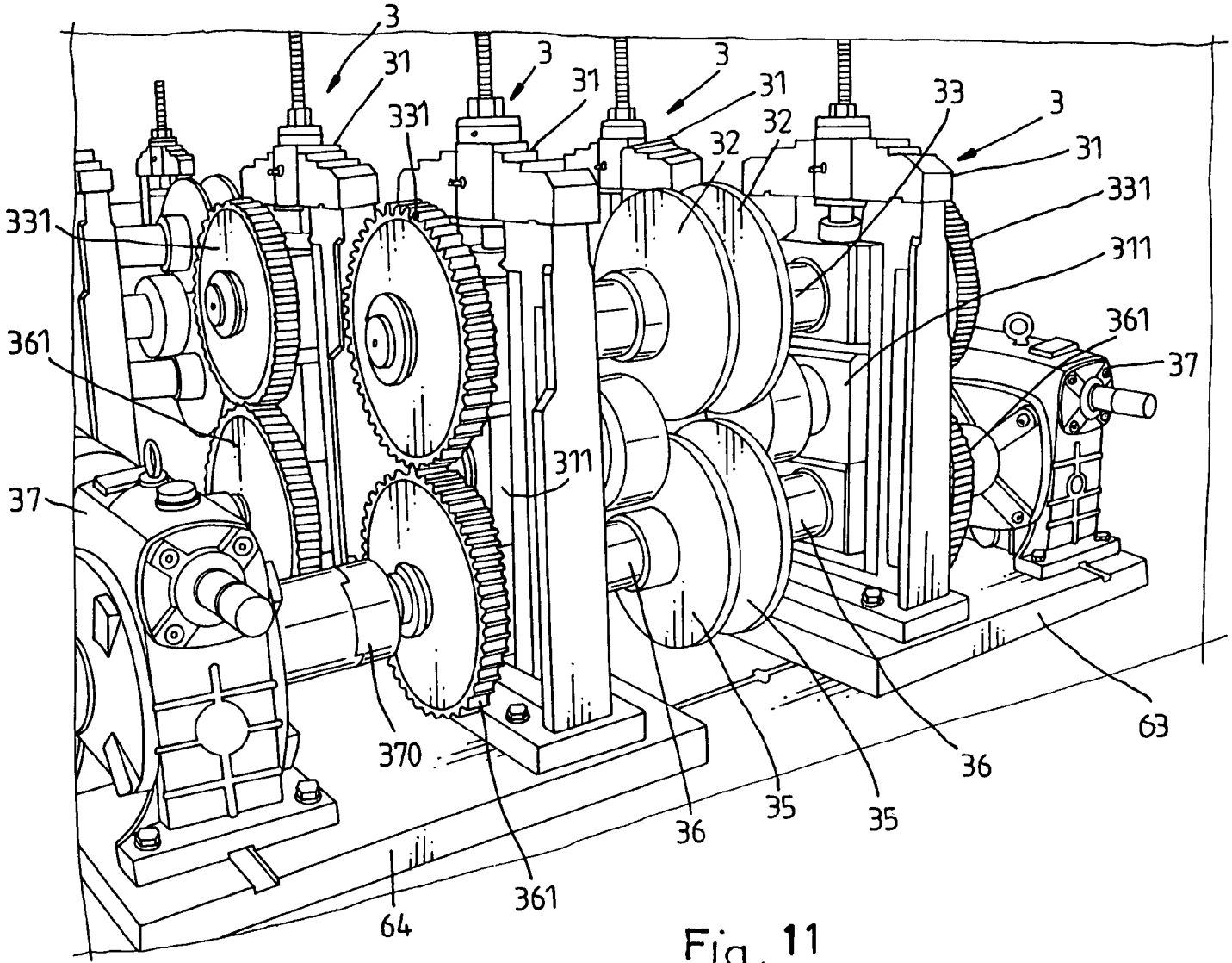
FIG. 11 is an enlarged view of still another part of the roll-forming machine according to the present invention.

Referring to FIGS. 5 and 12, the aforesaid two motors 38 of the roll-forming machine are respectively disposed at the left and right sides of the machine base 2, and respectively coupled to the reduction gear boxes 37 of the forming roll sets 3 through couplings 382 and transmission shafts 381.

Figure 29:
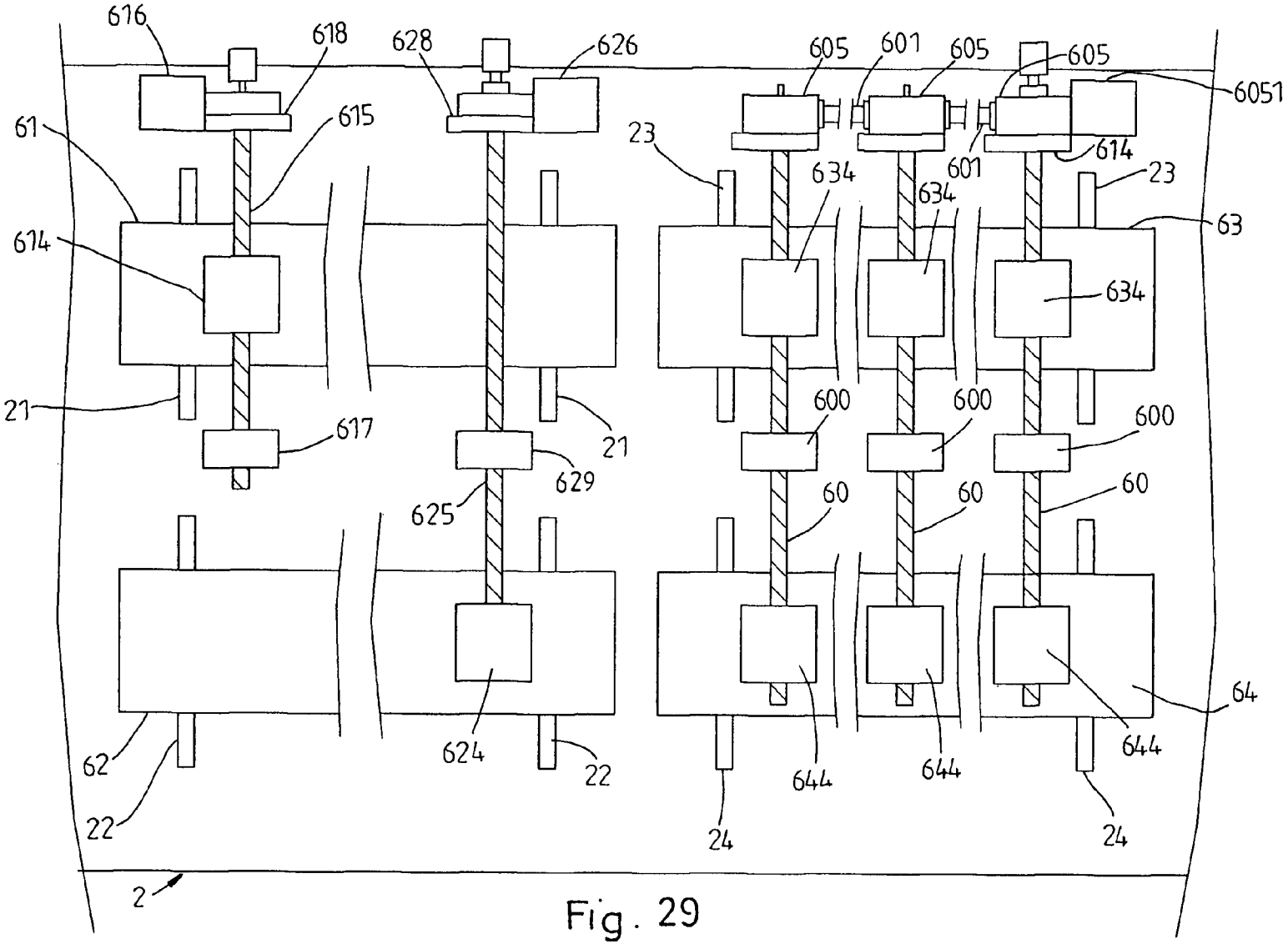
FIG. 29 is a schematic top plain view showing adjustment of the pitch between the first left-side carrier plate and the first right-side carrier plate and adjustment of the pitch between the second left-side carrier plate and the second right-side carrier plate adjustable.

Referring to FIG. 29, the first left-side carrier plate 61 comprises a screw guide block 614 fixedly provided at the top side, and a guide screw 615 threaded through the screw guide block 614. The guide screw 615 has one end coupled to a motor 616 at a motor mount 618 at the machine base 2, and the other end supported on a support 617 at the machine base 2. When started the motor 616, the guide screw 615 is rotated, causing the first left-side carrier plate 61 to move along the respective left-side rail 21. The first right-side carrier plate 62 comprises a screw guide block 624 fixedly provided at the top side, and a guide screw 625 threaded through the screw guide block 624. The guide screw 625 has one end coupled to a motor 626 at a motor mount 628 at the machine base 2, and the other end supported on a support 629 at the machine base 2. When started the motor 626, the guide screw 625 is rotated, causing the first right-side carrier plate 62 to move along the respective right-side rail 22. Therefore, the pitch between the first left-side carrier plate 61 and the first right-side carrier plate 62 is adjustable.

Further, the second left-side carrier plate 63 has a plurality of screw guide blocks 634 fixedly provided at the top side; the second right-side carrier plate 64 has a plurality of screw guide blocks 644 fixedly provided at the top side corresponding to the screw guide blocks 634 at the second left-side carrier plate 63; and a plurality of guide screws 60 are respectively threaded through the screw guide blocks 634 at the second left-side carrier plate 63 and a respective support 600 at the machine base 2 and the screw guide blocks 644 at the second right-side carrier plate 64. The guide screws 60 each have one end coupled to a respective steerer 605. The steerers 605 at the guide screws 60 are coupled to one another by transmission shafts 601, and then coupled to a motor 6051. When started the motor 6051, the steerers 605 and the transmission shafts 601 are driven to rotate the guide screws 60, thereby causing the second left-side carrier plate 63 and the second right-side carrier plate 64 to be moved relative to each other. Therefore, by means of controlling forward/backward rotation of the motor 6051, the pitch between the second left-side carrier plate 63 and the second right-side carrier plate 64 is adjusted.

As indicated above, the invention provides a roll-forming machine, which has the following advantages:

1. A sufficient partition space is provided between the forming roll sets 3 at the left side and the forming roll sets at the right side for easy performance of maintenance and repair works. When the impression wheels 32 or sheet-transfer wheels 35 of the forming roll sets 3 are worn with a long use or damaged, the workers can easily unfasten the respective fastening members 50 from the impression wheels 32 or sheet-transfer wheels 35 and the respective shafts 33 or 36 and remove the impression wheels 32 or sheet-transfer wheels 35 from the respective shafts 33 or 36 for repair or replacement.

2. The wheel shafts 341 of the shape-forming wheels 34 of the $1^{st}$ and $4^{th}$ pairs of forming roll sets 3 are respectively mounted with a respective locating block 312 through which the respective wheel shafts 341 can be rotated through 180° between two positions and locked by a respective locating rod 314, setting the roll-forming machine for processing C-shaped component or Z-shaped component.

3. The pitch between the first left-side carrier plate 61 and the first right-side carrier plate 62 and the pitch between the second left-side carrier plate 63 and the second right-side carrier plate 64 are adjustable for processing different sizes of C-shaped components or Z-shaped components.

A prototype of roll-forming machine has been constructed with the features of FIGS. 2~29. The roll-forming machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A roll-forming machine for the formation of C-shaped components and Z-shaped component selectively from sheet material, comprising:

a machine base, said machine base comprising a guide block unit provided at a front side thereof for guiding in a sheet material for processing;

a plurality of forming roll sets for selectively processing said sheet material into a shape selected from a group consisting of C-shaped components and Z-shaped components, each said forming roll set comprising a rack, a first shaft and a second shaft pivotally mounted in said rack and positioned horizontally at different elevations, an impression wheel fixedly mounted on a first end of said first shaft, a first gear wheel fixedly mounted on a second end of said first shaft, a sheet-transfer wheel fixedly mounted on a first end of said second shaft corresponding to said impression wheel, a second gear wheel fixedly mounted on a second end of said second shaft and meshed with said first gear wheel, a shape-forming wheel, which has a wheel shaft pivotally mounted in a wheel holder at said rack and is adapted to ram the sheet material being delivered through the gap between said impression wheel and said sheet-transfer wheel into a predetermined shape, a reduction gear box, and a coupling coupled between said reduction gear box and said second shaft, a plurality of pairs of forming roll sets are sequentially arranged along the machine base, each of the plurality of pairs of forming roll sets includes two of the plurality of forming roll sets;

two forming roll set driving motors disposed at two opposite lateral sides of said machine base and adapted to drive the reduction gear boxes of said forming roll sets;

a first bottom auxiliary shape-forming wheel set located between two adjacent pairs of forming roll sets and adapted to shape a bottom part of a processed sheet material into a 90° contained angle;

a second bottom auxiliary shape-forming wheel set located between two adjacent pairs of forming roll sets and adapted to shape each of two sides of the bottom part of the sheet material processed through said first bottom auxiliary shape-forming wheel set into a predetermined angle;

a top auxiliary shape-forming wheel set located between two adjacent pairs of forming roll sets and adapted to shape each of two sides of a top part of the processed sheet material into a predetermined angle;

a small straightener set between two adjacent pairs of forming roll sets and adapted to straighten a wall of the processed sheet material; and a big straightener set at a rear side machine base and adapted to straighten a wall of a finished C-shaped component or Z-shaped component;

when a sheet material passed through said guide block unit to said machine base, the sheet material is transferred in proper order through the impression wheel and sheet-transfer wheel of each said forming roll set and then processed in proper order by the shape-forming wheel of each said forming roll set, said first bottom auxiliary shape-forming wheel set, said second bottom auxiliary shape-forming wheel set, said top auxiliary shape-forming wheel set, said small straightener and said big straightener into the desired C-shaped component; when the operator positions the shape-forming wheels of assigned forming roll sets on opposing surfaces of the prepared sheet material, the roll-forming machine is set to process the prepared sheet material into a Z-shaped component;

wherein:

said plurality of forming roll sets are arranged into 15 pairs of forming roll sets numbered from $1^{st}$ through $15^{th}$, the two forming roll sets of each pair of forming roll sets being symmetrically disposed at left and right sides on said machine base such that a gap is defined between the two impression wheels of each pair of forming roll sets, and a gap is defined between the two sheet-transfer wheels of each pair of forming roll sets; the two racks of each pair of forming roll sets are respectively mounted on a first left-side carrier plate and second left-side carrier plate and a first right-side carrier plate and second right-side carrier plate, said first left-side carrier plate and said first right-side carrier plate having a respective bottom side respectively mounted with slides that are respectively coupled to a left-side rail and a right-side rail at said machine base, said second left-side carrier plate and said second right-side carrier plate having a respective bottom side respectively mounted with slides that are respectively coupled to a left-side rail and a right-side rail at a rear side of said machine base, wherein each of the first bottom auxiliary shape-forming wheel set, the second bottom auxiliary shape-forming wheel set, the top auxiliary shape-forming wheel set, the small straightener set, and the big straightener set are separated by at least one of the plurality of pairs of forming roll sets.

2. The roll-forming machine as claimed in claim 1, wherein the wheel holder of each said forming roll set comprises a coupling hole for receiving the wheel shaft of the respective shape-forming wheel; the wheel holder of one said forming roll sets having two coupling grooves horizontally arrange din parallel at two sides of the coupling hole thereof, and a locating block fastened to the wheel shaft of the shape-forming wheel in said coupling hole with fastening members, said locating block having two coupling grooves symmetrically disposed at two opposite lateral sides and being rotatable with the wheel shaft of the shape-forming wheel in said coupling hole through 180° between two positions to let one coupling groove of said locating block be connected to one coupling groove of the respective wheel holder and one coupling groove of the wheel shaft of the respective shape-forming wheel by a locating rod, so that when the shape-forming wheel of one of the $1^{st}$ pair of forming roll sets and the shape-forming wheel of the corresponding one of the $4^{th}$ pair of forming roll sets are turned through 180°, the respective shape-forming wheels at the left side and the respective shape-forming wheels at the right side are asymmetric and the roll-forming machine is set to ram the prepared sheet material into the desired Z-shaped component.

3. The roll-forming machine as claimed in claim 1, wherein said two forming roll set driving motors are respectively disposed at left and right sides of said machine base, and respectively coupled to the reduction gear boxes of said forming roll sets through couplings and transmission shafts.

4. The roll-forming machine as claimed in claim 1, wherein said first left-side carrier plate comprises a screw guide block fixedly provided at a top side thereof, and a guide screw threaded through the screw guide block at said first left-side carrier plate, said guide screw having a first end coupled to a motor at a motor mount at said machine base and a second end supported on a support at said machine base such that when started the motor being coupled to the guide screw at said first left-side carrier plate, the guide screw at said first left-side carrier plate is rotated to move said first left-side carrier plate along the respective left-side rail; said first right-side carrier plate comprises a screw guide block fixedly provided at a top side thereof and a guide screw threaded through the screw guide block at said first right-side carrier plate, the guide screw at said first right-side carrier plate having a first end coupled to a motor at a motor mount at said machine base and a second end supported on a support at said machine base such that when started the motor being coupled to the guide screw at said first right-side carrier plate, the guide screw at said first right-side carrier plate is rotated to move said first right-side carrier plate along the respective right-side rail.

5. The roll-forming machine as claimed in claim 1, wherein said second left-side carrier plate has a plurality of screw guide blocks fixedly provided at a top side thereof; said second right-side carrier plate has a plurality of screw guide blocks fixedly provided at a top side thereof corresponding to the screw guide blocks at said second left-side carrier plate; a plurality of guide screws are respectively threaded through the screw guide blocks at said second left-side carrier plate and a respective support at said machine base and the screw guide blocks at said second right-side carrier plate, each having one end coupled to a respective steerer, the steerers at the guide screws being coupled to one another by transmission shafts and then coupled to a motor such that starting the motor causes the steerers and the transmission shafts to rotate the guide screws at said second left-side carrier plate and said second right-side carrier plate and to further move said second left-side carrier plate and said second right-side carrier plate relative to each other.

* * * * *